US010321767B2

(12) United States Patent
Jin

(10) Patent No.: US 10,321,767 B2
(45) Date of Patent: Jun. 18, 2019

(54) SUPPORTS, FOLDING MECHANISMS AND FOLDABLE SUPPORTING FRAMES

(71) Applicant: Inno-Sports Co., Ltd., Xiamen (CN)

(72) Inventor: Ju Young Jin, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 334 days.

(21) Appl. No.: 15/056,150

(22) Filed: Feb. 29, 2016

(65) Prior Publication Data

US 2016/0262547 A1 Sep. 15, 2016

(30) Foreign Application Priority Data

Feb. 27, 2015 (CN) ..... 2015 2 0117011 U
Feb. 27, 2015 (CN) ..... 2015 2 0117012 U
Feb. 27, 2015 (CN) ..... 2015 2 0117014 U
Feb. 27, 2015 (CN) ..... 2015 2 0117015 U
Feb. 27, 2015 (CN) ..... 2015 2 0117037 U

(51) Int. Cl.
*A47C 19/02* (2006.01)
*A47C 19/12* (2006.01)
*A47C 17/70* (2006.01)

(52) U.S. Cl.
CPC ..... *A47C 19/025* (2013.01); *A47C 17/70* (2013.01); *A47C 19/021* (2013.01); *A47C 19/12* (2013.01); *A47C 19/124* (2013.01)

(58) Field of Classification Search
CPC ..... A47C 17/70; A47C 17/74; A47C 19/021; A47C 19/025; A47C 19/122; A47C 19/124; A47C 19/00; A47C 19/12
See application file for complete search history.

(56) References Cited

U.S. PATENT DOCUMENTS 605,126 A 6/1898 Odell
1,070,525 A 8/1913 Pieper
1,196,253 A * 8/1916 Lowy ..... A47C 19/122 5/154
1,259,825 A 3/1918 Basile
1,360,983 A 11/1920 Burton
1,530,726 A 3/1925 Koenigkramer
1,574,659 A 2/1926 Johnston
2,513,168 A 6/1950 Gottlieb
2,651,787 A 9/1953 Piliero
2,671,229 A 3/1954 Vernier
2,678,085 A 5/1954 De Minno
(Continued)

*Primary Examiner* — Robert G Santos
*Assistant Examiner* — David R Hare
(74) *Attorney, Agent, or Firm* — Morgan, Lewis & Bockius LLP

(57) ABSTRACT

Disclosed are supports, folding mechanisms and foldable supporting frames. A foldable supporting frame includes a plurality of bent bars, folding mechanisms and supports. The bent bars are connected to each other by the folding mechanisms and the supports to form upper and lower frames of the foldable supporting frame. The foldable supporting frame can be folded and unfolded by rotating any one of the bent bars. When unfolded, the supports hold the upper frame in place and keep it flat and stable. When folded, the folding mechanisms and the supports allow the bent bars to move toward each other and fold onto each other. The folded supporting frame is compact and of a regular shape, making it easier to handle, package, store, and transport.

19 Claims, 20 Drawing Sheets

(56) References Cited

U.S. PATENT DOCUMENTS 2,701,603 A * 2/1955 Coopersmith ..... A47C 4/22 297/19
2,782,075 A 2/1957 Fagan
2,888,688 A 6/1959 Bereman
3,245,363 A 4/1966 Kanitz
3,295,149 A 1/1967 Hall
4,048,683 A * 9/1977 Chen ..... A47C 19/122 5/174
4,620,336 A 11/1986 Miller
4,654,905 A 4/1987 Miller
5,894,614 A 4/1999 Stroud
6,151,730 A * 11/2000 Weston ..... A47C 19/122 5/110
7,376,989 B2 5/2008 Wickstrom
7,406,727 B2 8/2008 Wickstrom
7,503,086 B2 3/2009 Wickstrom
8,312,576 B1 11/2012 Oh
8,370,973 B1 * 2/2013 Oh ..... A47C 19/122 5/174
8,769,740 B2 7/2014 Oh
8,898,832 B2 12/2014 Oh
9,226,590 B1 1/2016 Hull
9,314,386 B1 * 4/2016 Boyd ..... A61G 7/015
9,456,699 B1 10/2016 Oh
9,526,347 B2 12/2016 Boyd
9,538,850 B2 1/2017 Oh
9,907,405 B2 3/2018 An
10,034,551 B2 7/2018 Hull
10,123,629 B2 11/2018 Choi
2005/0251911 A1 11/2005 Wickstrom
2006/0195982 A1 9/2006 Cloer
2006/0230532 A1 10/2006 Wickstrom
2008/0000024 A1 1/2008 Peixin
2009/0293193 A1 12/2009 Neatherry
2011/0073723 A1 * 3/2011 Ashpole ..... A47C 4/20 248/176.2
2011/0099712 A1 5/2011 Jin
2012/0042449 A1 2/2012 Hull
2012/0222216 A1 9/2012 Jin
2013/0067659 A1 * 3/2013 Oh ..... A47C 19/12 5/400
2013/0067862 A1 3/2013 Oh
2014/0345044 A1 * 11/2014 Murphy ..... A47C 17/225 5/14
2015/0320225 A1 11/2015 Boyd
2016/0302582 A1 10/2016 Oh
2017/0119166 A1 * 5/2017 An ..... A47C 19/122
2018/0116412 A1 * 5/2018 Jin ..... A47C 19/025

* cited by examiner

SUPPORTS, FOLDING MECHANISMS AND FOLDABLE SUPPORTING FRAMES

CROSS-REFERENCE TO RELATED APPLICATIONS

This application claims the benefit of Chinese Application No. 201520117011.8, filed Feb. 27, 2015, Chinese Application No. 201520117012.2, filed Feb. 27, 2015, Chinese Application No. 201520117014.1, filed Feb. 27, 2015, Chinese Application No. 201520117015.6, filed Feb. 27, 2015, and Chinese Application No. 201520117037.2, filed Feb. 27, 2015.

1. FIELD OF THE INVENTION

The present invention generally relates to supports, folding mechanisms and foldable supporting frames having the supports and folding mechanisms. More particularly, the present invention relates to supports, folding mechanisms and foldable supporting frames for supporting mattresses, cushions, box springs or the like.

2. BACKGROUND

Currently, mattresses, cushions, box springs or the like are arranged in two ways. One is for relatively shorter people such as Asians and the other is for relatively taller people such as Americans and Europeans.

In the first way, mattresses, cushions, or box springs are placed directly on bed frames. To hold and stabilize mattresses, cushions, or box springs, most of bed frames include crossbars. For comfort and luxury, bed frames are usually made of woods and in different colors. To ensure stability and maintain aesthetic appearance, these bed frames are not foldable. As bed frames are usually large, for example, typical standard sizes including 1.8 m by 1.8 m and 2.0 m by 2.0 m, packaging, moving and shipping such bed frames create a challenge.

In the second way, supporting frames are added to bed frames to increase the heights of beds. Supporting frames are placed on bed frames and mattresses, cushions, or box springs are then placed on the supporting frames. In such cases, there is no need to modify bed frames to accommodate relatively taller people or personal preferences. However, most of current supporting frames are not foldable and thus it is difficult to package, move and transport such supporting frames. Although some of current supporting frames are foldable, they generally have complex structures and irregular shapes when folded. Thus, it is difficult to use, package, move and transport these foldable supporting frames.

Given the above background, there is a need in the art for support frames and related components that are relatively simple, stable, easier to use, and configured for convenient packaging, shipping and transportation.

The information disclosed in this Background section is provided for an understanding of the general background of the invention and is not an acknowledgement or suggestion that this information forms part of the prior art already known to a person skilled in the art.

3. SUMMARY

Various aspects of the present invention provide supports, folding mechanisms and foldable supporting frames that are relatively simple, stable, and easier to use, package, move and transport.

In one aspect, the present invention provides a foldable supporting frame including a plurality of bent bars, a plurality of supports and a plurality of folding mechanisms. The plurality of bent bars includes first and second bent bars to form an upper frame, and third and fourth bent bars to form a lower frame. Each of the first, second, third and fourth bent bars include first and second free ends. Each support includes a supporting piece having an upper part pivotally connected to the upper frame and a lower part pivotally connected to the lower frame. The plurality of folding mechanisms includes first and second folding mechanisms. Each of the first and second folding mechanisms includes a first link having a left upper part pivotally connected to the first or second free end of the first bent bar, and having a right upper part pivotally connected to the first or second free end of the second bent bar. Each of the first and second folding mechanisms further includes one or more of the following: (i) a second link having a lower part coupled to the first or second free end of the third bent bar, and a third link having a lower part coupled to the first or second free end of the fourth bent bar, wherein the second and third links are pivotally connected to each other at upper parts thereof; and (ii) a fourth link having one end pivotally connected to a lower part of the first link and the other end pivotally connected to an adjacent support.

In another aspect, the present invention provides a foldable supporting frame including a plurality of bent bars, a plurality of folding mechanisms and a plurality of supports. The plurality of bent bars includes first and second bent bars to form an upper frame, and third and fourth bent bars to form a lower frame. Each of the first, second, third and fourth bent bars include first and second free ends. The plurality of folding mechanisms includes first and second folding mechanisms. The first folding mechanism pivotally connects the first free end of the first bend bar with the first free end of the second bent bar, and the second mechanism pivotally connects the second free end of the first bent bar with the second free end of the second bent bar, thereby forming an upper frame of the foldable supporting frame. The first folding mechanism pivotally connects the first free end of the third bend bar with the first free end of the fourth bent bar, and the second mechanism pivotally connects the second free end of the third bent bar with the second free end of the fourth bent bar, thereby forming a lower frame of the foldable supporting frame. Each support includes a supporting piece and a restraining piece. The supporting piece has an upper part pivotally connected to the upper frame of the foldable supporting frame and a lower part pivotally connected to the lower frame of the foldable supporting frame. The restraining piece is extended from the supporting piece and bent at a predetermined angle with respect to the supporting piece. The restraining piece has an upper surface and a lower surface. When the foldable supporting frame is unfolded, the upper surface of the restraining piece is below the upper frame of the foldable supporting frame and in direct contact with a lower surface of the upper frame, thereby preventing further unfolding of the foldable supporting frame.

In yet another aspect, the present invention provides a support for supporting a foldable supporting frame having an upper frame and a lower frame. The support includes a supporting piece and a restraining piece. The supporting piece has an upper part configured to be pivotally connected to the upper frame of the foldable supporting frame and a lower part configured to be pivotally connected to the lower frame of the foldable supporting frame. The restraining piece is extended from the supporting piece and bent at a predetermined angle with respect to the supporting piece. The restraining piece has an upper surface and a lower surface. When the foldable supporting frame is unfolded, the upper surface of the restraining piece is below the upper frame of the foldable supporting frame, and in direct contact with a lower surface of the upper frame. As such, the support prevents the upper frame from further and undesired unfolding.

In still another aspect, the present invention provides a folding mechanism for connecting a plurality of bent bars to form a foldable supporting frame. The plurality of bent bars includes first, second, third and fourth bent bars, each having a free end. The folding mechanism includes a first link having a left upper part configured to be pivotally connected to the free end of the first bent bar, and having a right upper part configured to be pivotally connected to the free end of the second bent bar. The folding mechanism further includes one or more of the following: (i) a second link having a lower part configured to be coupled to the free end of the third bent bar, and a third link having a lower part configured to be coupled to the free end of the fourth bent bar, wherein the second and third links are pivotally connected to each other at upper parts thereof; and (ii) a fourth link having one end pivotally connected to a lower part of the first link and the other end pivotally connected to an adjacent support of the foldable supporting frame.

In one embodiment, the supporting piece and the restraining piece are substantially perpendicular to each other.

In some embodiments, one of the upper and lower parts of the supporting piece includes a substantially horizontally extended first pivotal portion. The first pivotal portion is configured to match with a side surface of one of the upper and lower frames and be pivotally connected to the one of the upper and lower frames. The other of the upper and lower parts of the supporting piece includes a substantially vertically extended second pivotal portion. The second pivotal portion is configured to match with a side surface of the other of the upper and lower frames and be pivotally connected to the other of the upper and lower frames. In an embodiment, the restraining piece, the first pivotal portion and the second pivotal portion are substantially perpendicular to each other.

In some embodiments, the support further includes a connecting piece having an upper part pivotally coupled to the lower part of the supporting piece and a lower part configured to be fixedly coupled to the lower frame of the foldable supporting frame. In an embodiment, the connecting piece is substantially perpendicular to the lower frame of the foldable supporting frame. In a preferred embodiment, the connecting piece is bent in between the upper part and the lower part of the connecting piece.

In one embodiment, the second link and the third link are positioned substantially symmetrically with respect to each other.

In some embodiments, the second link is bent between the upper part and a lower part such that the upper part forms a recessed step with respect to the lower part of the second link. The third link is bent between the upper part and a lower part such that the upper part forms a recessed step with respect to the lower part of the third link. The second link and the third links are pivotally connected to each other within the recessed steps. In an embodiment, bending edges of the second and third links are slanted with respect to a horizontal line when the foldable supporting frame is unfolded.

In one embodiment, the lower part of the second link is configured to be pivotally connected to the free end of the third bent bar, and the lower part of the third link is configured to be pivotally connected to the free end of the fourth bent bar. In another embodiment, the lower part of the second link is configured to be fixedly connected to the free end of the third bent bar, and the lower part of the third link is configured to be fixedly connected to the free end of the fourth bent bar.

In some embodiments, the lower part of the first link and upper parts of the second and third links are pivotally connected to each other. In a preferred embodiment, pivot points, at which the first link connects with the first bent bar, with the second bar and with the second and third links, are positioned triangularly. In another preferred embodiment, a pivot point at which the first link connects with the first bent bar and a pivot point at which the first link connects with the second bar are positioned substantially symmetrically with respect to a pivot point at which the first link connects with the second and third links.

In some embodiments, the first, second, third and fourth bent bars are substantially the same as each other. In some embodiments, each of the first, second, third and fourth bent bars include a lateral part and two longitudinal parts. Each longitudinal part is extended longitudinally from one end of the lateral part. The plurality of supports are disposed between a longitudinal part of the first bent bar and a corresponding longitudinal part of the third bent bar, and between a longitudinal part of the second bent bar and a corresponding longitudinal part of the fourth bent bar. In a preferred embodiment, the supports are disposed evenly within a pair of the longitudinal part of the first and third bent bars or within a pair of the longitudinal part of the second and fourth bent bars.

In some embodiments, the foldable supporting frame further includes a plurality of crossbars, each crossbar having two ends connected to longitudinal parts of one of the first, second, third and fourth bent bars. In some embodiments, when the foldable supporting frame is unfolded, the upper frame and lower frame are substantially flat and are substantially parallel to each other.

The systems of the present invention have other features and advantages that will be apparent from or are set forth in more detail in the accompanying drawings, which are incorporated herein, and the following Detailed Description, which together serve to explain certain principles of the present invention.

4. BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

5. DETAILED DESCRIPTION

Figure 1:
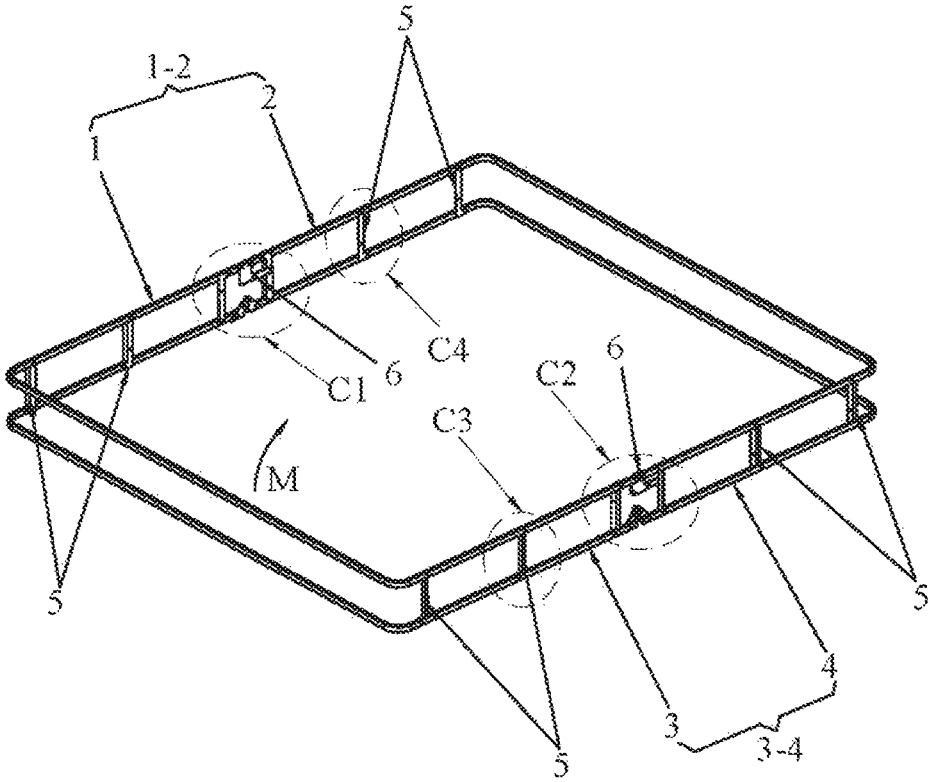
FIG. 1 is a schematic perspective view illustrating a foldable supporting frame in an unfolded state in accordance with some embodiments of the present invention.

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of supporting frames that support mattresses, cushions, box springs or the like. The supporting frames can be of various sizes including but not limited to twin, full, queen and king sizes, and of various shapes including but not limited to rectangles and squares. Also, the supporting frames can be made of various materials including but not limited to metals such as steel, plastics and woods. The supporting frames can be used alone or in conjunction with bed frames. For example, the supporting frames can be placed on bed frames, before placing support mattresses, cushions, box springs or the like on the supporting frames, to increase the heights of the beds to accommodate users' different heights or preferences.

Generally, a supporting frame of the present invention includes a plurality of bent bars pivotally and selectively connected to each other by folding mechanisms to form an upper frame and a lower frame of the supporting frame. The supporting frame of the present invention also includes a plurality of supports disposed between the upper and lower frames and pivotally connected to the upper and lower frames. Because the bent bars are connected to each other through the folding mechanisms and/or the supports, the foldable supporting frame of the present invention can be folded or unfolded by rotating any one of the bent bars. As such, the supporting frames of the present invention are easier to fold and unfold, and convenient for handling, packaging, storing, shipping and transportation. By way of example, FIGS. 1-5A illustrate folding of the supporting frame by rotating first bent bar 1 along a direction indicated by arrow M in FIG. 1, and FIGS. 6-10A illustrate folding of the supporting frame by rotating first bent bar 1' along a direction indicated by arrow M' in FIG. 6. It should be understood that the foldable supporting frame of the present can be folded or unfolded by rotating other bent bars such as second, third or fourth bent bar or more than one bent bar at the same time.

The present application discloses two types of exemplary folding mechanisms, i.e., first exemplary folding mechanism 6 illustrated in FIGS. 1-5A and second exemplary folding mechanism 6' illustrated in FIGS. 6-10A. The present application also discloses two types of exemplary supports, i.e., first exemplary supports 5 illustrated in FIGS. 1-5A and second exemplary supports 5' illustrated in FIGS. 6-10A. First exemplary folding mechanism 6 can be used along with either first exemplary supports 5 or second exemplary supports 5' or combination of first exemplary supports 5 and second exemplary supports 5'. Similarly second exemplary folding mechanism 6' can be used along with either first exemplary supports 5 or second exemplary supports 5' or combination of first exemplary supports 5 and second exemplary supports 5'. Further, first exemplary folding mechanism 6 and second exemplary folding mechanism 6' can be used in the same supporting frame. By way of example only, FIGS. 1-5A depict a foldable supporting frame including first exemplary folding mechanisms 6 and first exemplary supports 5, and FIGS. 6-10A depict a foldable supporting frame including second exemplary folding mechanisms 6' and second exemplary supports 5'.

Referring now to FIGS. 1-5A, in some embodiments, a foldable supporting frame of the present invention includes a plurality of bent bars, such as first bent bar 1, second bent bar 2, third bent bar 3 and fourth bent bar 4. The plurality of bent bars are selectively and pivotally connected to each other by a plurality of first exemplary folding mechanisms 6 to form an upper frame such as upper frame 1-2 and a lower frame such as lower frame 3-4. In various embodiments, the foldable supporting frame also includes a plurality of first exemplary supports 5 disposed between the upper and lower frames and pivotally connected to the upper and lower frames.

Figure 5:
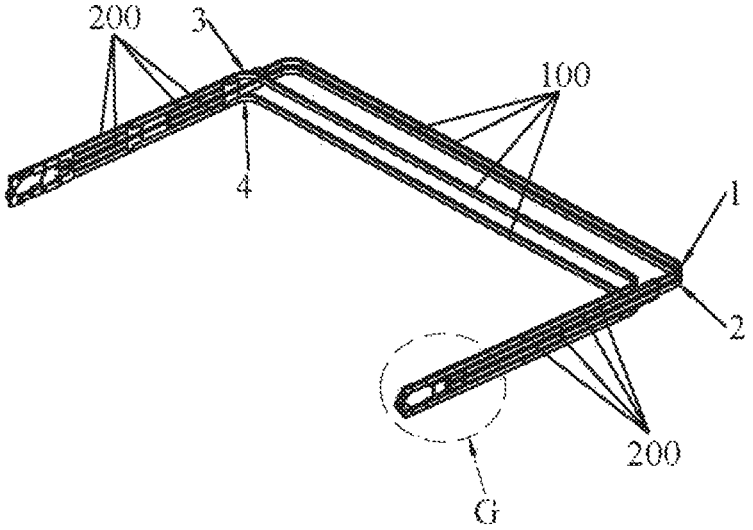
FIG. 5 is a schematic perspective view illustrating a foldable supporting frame in a fourth folded state in accordance with some embodiments of the present invention.

In some embodiments, for the purposes of master production, assembling convenience, easy packaging or the like, first bent bar 1, second bent bar 2, third bent bar 3 and fourth bent bar 4 are made to be the same or substantially the same as each other. In such embodiments, when unfolded, the supporting frame is substantially symmetric with first bent bar 1 substantially symmetric to second bent bar 2 and third bent bar 3 substantially symmetric to fourth bent bar 4. When folded, first bent bar 1 coincides with second bent bar 2 and third bent bar 3 coincides with fourth bent bar 4, with first bent bar 1 and second bent bar 2 in the middle as illustrated in FIG. 5. As a result, the folded supporting frame is more compact and of a regular shape, making it easier to handle, package, store, and transport. In some embodiments, each of the first, second, third and fourth bent bars includes lateral part 100 and two longitudinal parts 200 each extended longitudinally from one end of lateral part 100.

Figure 1A:
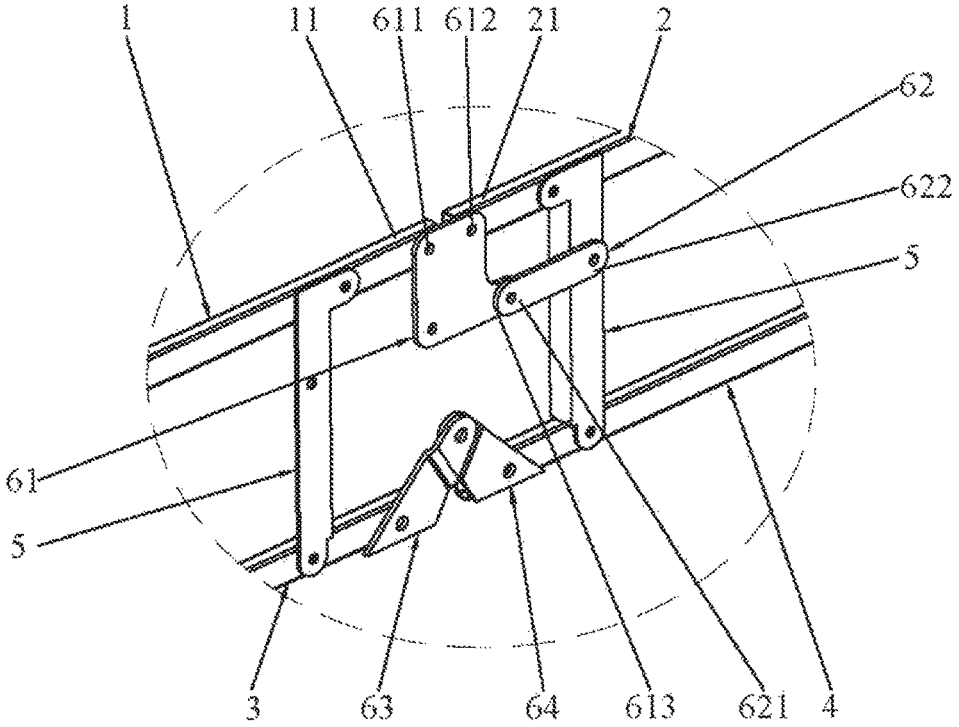
FIG. 1A is an enlarged view of circle C1 in FIG. 1 illustrating a first exemplary folding mechanism in accordance with some embodiments of the present invention.
Figure 1B:
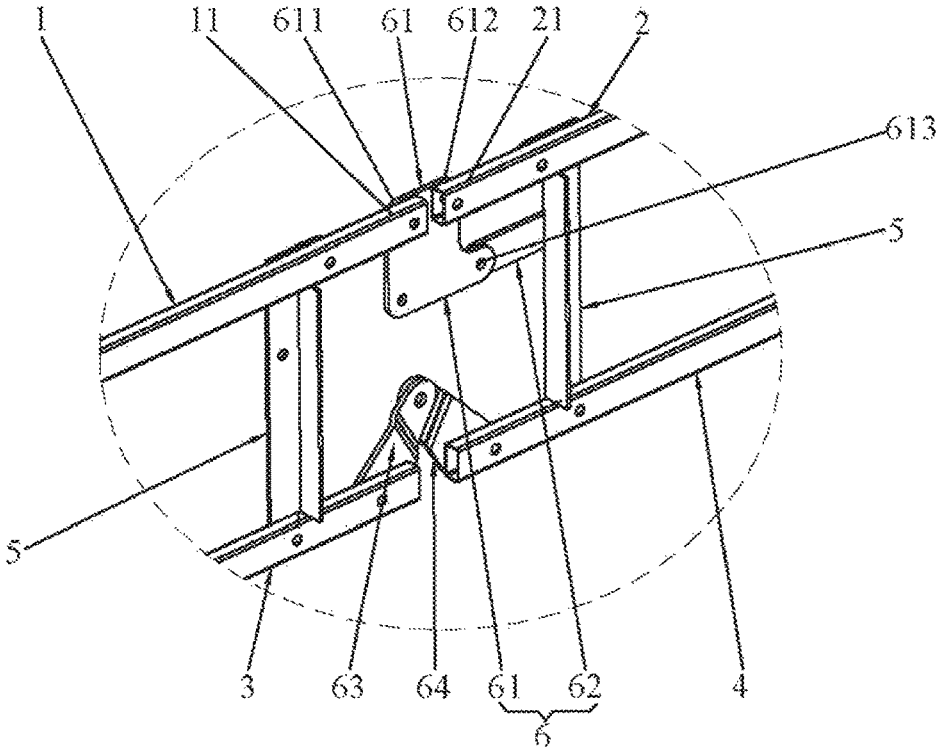
FIG. 1B is an enlarged view of circle C2 in FIG. 1 illustrating a first exemplary folding mechanism in accordance with some embodiments of the present invention.

In the illustrated embodiments, the supporting frame includes two first exemplary folding mechanisms 6, one shown in circle C1 and the other in circle C2. Enlarged views of these folding mechanisms 6 are shown in FIGS. 1A and 1B. In one embodiment, the two folding mechanisms are identical or substantially identical to each other. In another embodiment, the two folding mechanisms are reflection-symmetric or mirror-symmetric to each other. It should be understood that a supporting frame of the present invention can include more than two exemplary mechanisms and more than four bars (bent or straight) connected by the exemplary mechanisms.

In various embodiments, folding mechanism 6 includes one or more links pivotally connected to a bent bar or an adjacent support. For example, as shown in FIGS. 1A and 1B, folding mechanism 6 includes first link 61. First link 61 has left upper part 611 pivotally connected to free end 11 of first bent bar 1 and right upper part 612 pivotally connected to free end 21 of second bent bar 2. The connected first and second bent bars collectively form upper frame 1-2 of the foldable supporting frame.

In some embodiments, folding mechanism 6 includes optional or additional links to connect third and fourth bent bars to form the lower frame of the supporting frame. For example, FIGS. 1A and 1B illustrate second link 63 and third link 64, with the lower part of second link 63 pivotally connected to the free end of third bent bar 3 and the lower part of third link 64 pivotally connected to the free end of four bent bar 4. The upper parts of second link 63 and third link 64 are pivotally connected to each other. The connected third and fourth bent bars thus collectively form lower frame 3-4 of the foldable supporting frame. In one embodiment, second link 63 and third link 64 are positioned substantially symmetrically with respect to each other. It should be understood that second link 63 and third link 64 are not necessary since third bent bar 3 are pivotally coupled to fourth bent bar 4 through supports 5 and first link 61.

In some embodiments, folding mechanism 6 further includes fourth link 62 pivotally connected to first link 61 and adjacent support 5. For example, in the illustrated embodiments, fourth link 62 has one end 621 pivotally connected to right lower part 613 of first link 61 and another end 622 pivotally connected to an adjacent support 5 positioned between second bent bar 2 and fourth bent bar 4. In a preferred embodiment, right lower part 613 of first link 61 is extended (e.g., portion 61*b* illustrated in FIG. 2A) toward the adjacent support to which fourth link 62 is pivotally connected. It should be understood that first link 61 and fourth link 62 can be configured (e.g., flipping first link 61) such that fourth link 62 is pivotally connected to a left lower part of first link 61 and an adjacent support positioned between first bent bar 1 and third bent bar 3.

Figure 5A:
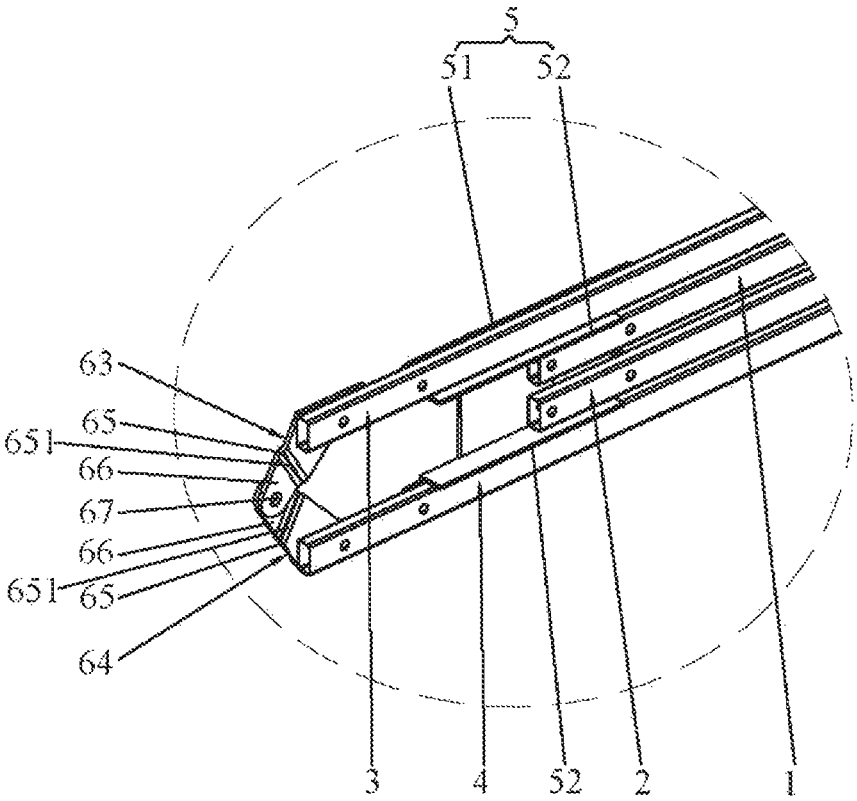
FIG. 5A is an enlarged view of circle G in FIG. 5 illustrating a first exemplary folding mechanism in accordance with some embodiments of the present invention.

In some embodiments, pivot points, at which first link 61 connects with first bent bar 1, with second bar 2 and with an adjacent support, are positioned triangularly. Such positioning of the pivot points ensures the coordination among the bent bars and prevents sways and offsets of the bent bars, and thus improves the stability of folding and unfolding the supporting frame. In some embodiments, first link 61 is configured to have a substantially rectangular main body (e.g., 61*a* in FIG. 2A) to further improve the stability of folding and unfolding the supporting frame. The rectangular shape of main body 61*a* also enhances the aesthetic appearance of the supporting frame when it is folded as illustrated in FIG. 5A.

Continuously referring to FIGS. 1-5A and in particular to FIGS. 1A, 2A, 3A, 4A and 5A, in some embodiments, second link 63 is bent between the upper part and the lower part, creating one bending structure 65 in which the upper part forms recessed step 66 with respect to the lower part of second link 63. Similarly, third link 64 is bent between the upper part and the lower part, creating another bending structure 65 in which the upper part forms recessed step 66 with respect to the lower part of third link 64. In such embodiments, second link 63 and third link 64 are pivotally connected to each other at pivot point 67 located within the recessed steps of second link 63 and third link 64. The recessed steps of second link 63 and third link 64 are in surface contact with each other. The contacting surfaces of the recessed steps guide and restrain rotation of second link 63 and third link 64, and thence guide and restrain rotation of the first, second, third and fourth bent bars. This reduces or eliminates sway, offset or any undesired movement of bent bars when folding or unfolding the supporting frame, and thus increases effectiveness, efficiency and accuracy of folding and unfolding the supporting frame. In addition, bending structures 65 enhance the strength and prolong the lifetime of second link 63 and third link 64.

In a preferred embodiment, bending edges 651 of second link 63 and third link 64 are slanted with respect to a horizontal line or corresponding bent bars when the foldable supporting frame is unfolded. Second link 63 and third link 64 are positioned and pivotally connected in such a way that bending edges 651 assist in guiding rotation of second link 63 and third link 64. This further increases folding/unfolding effectiveness, efficiency and accuracy of the supporting frame.

Figure 2:
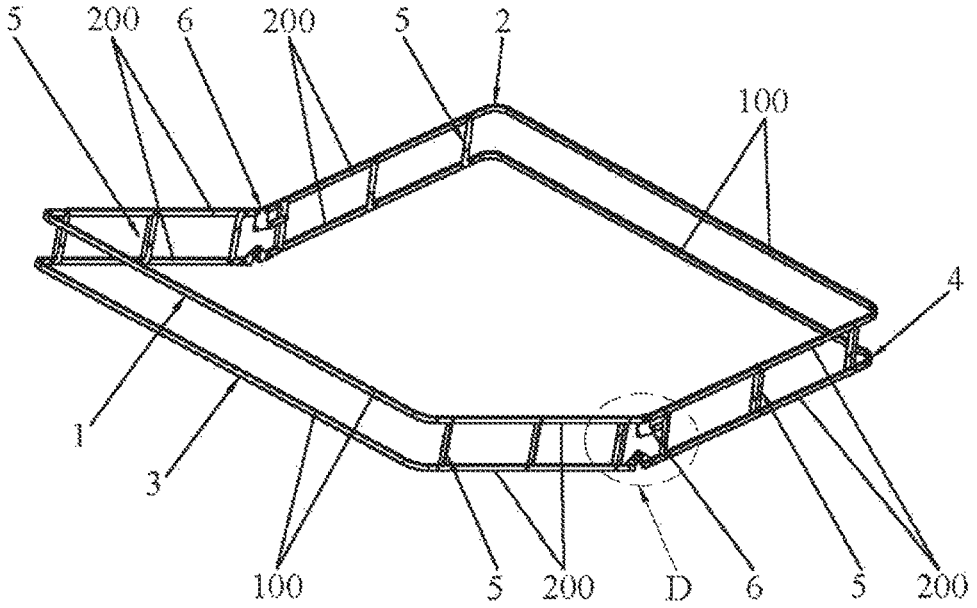
FIG. 2 is a schematic perspective view illustrating a foldable supporting frame in a first folded state in accordance with some embodiments of the present invention.
Figure 2A:
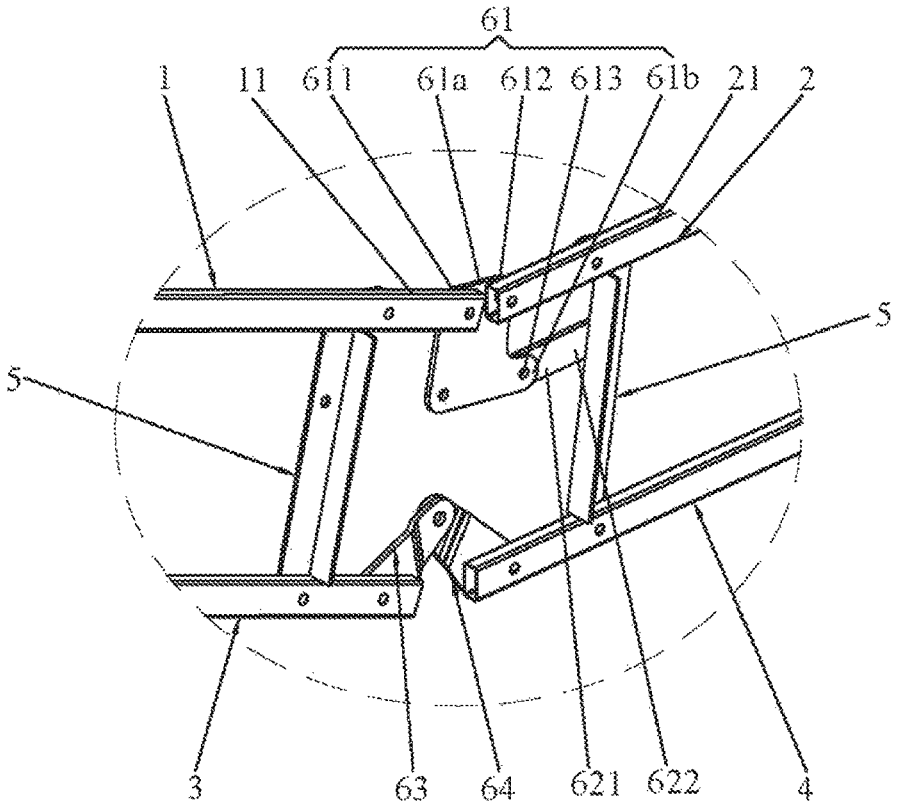
FIG. 2A is an enlarged view of circle D in FIG. 2 illustrating a first exemplary folding mechanism in accordance with some embodiments of the present invention.
Figure 3:
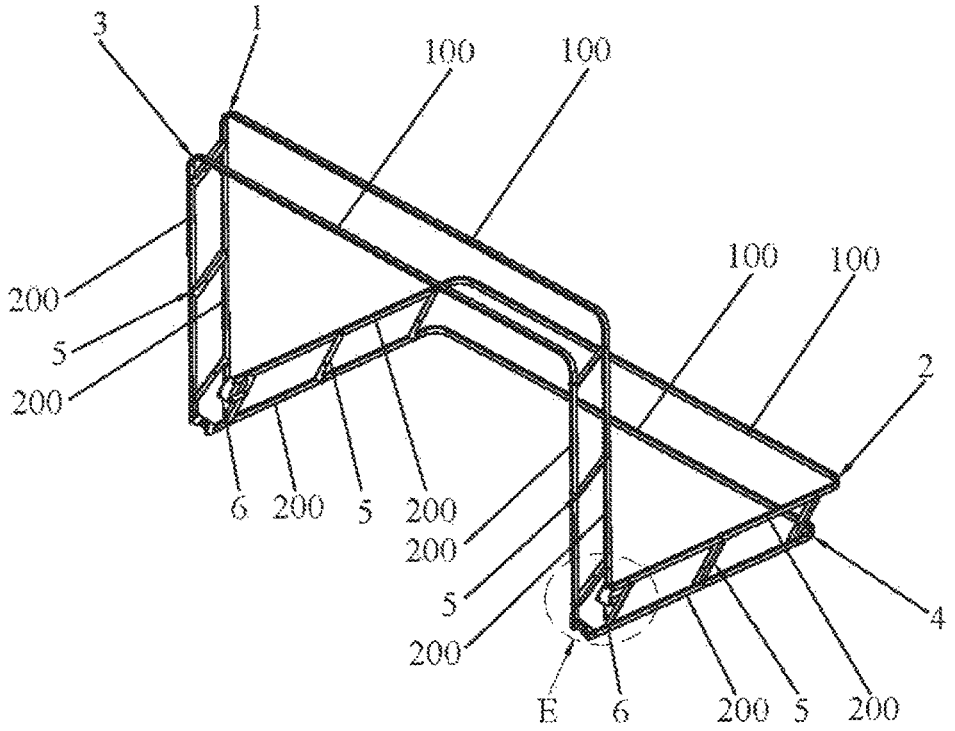
FIG. 3 is a schematic perspective view illustrating a foldable supporting frame in a second folded state in accordance with some embodiments of the present invention.
Figure 3A:
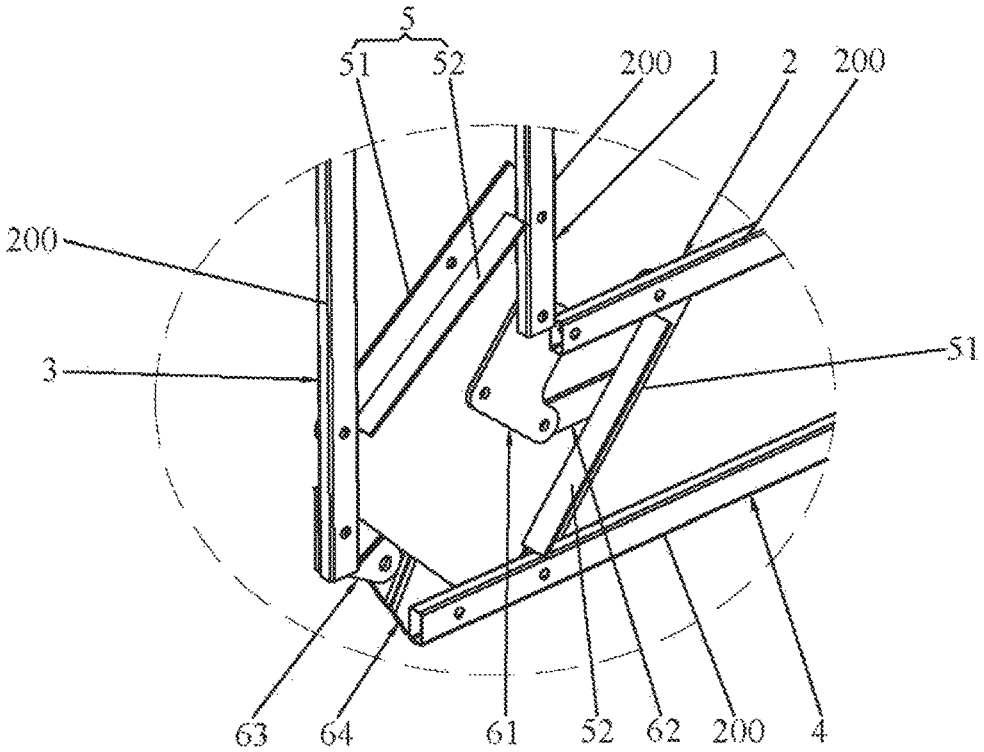
FIG. 3A is an enlarged view of circle E in FIG. 3 illustrating a first exemplary folding mechanism in accordance with some embodiments of the present invention.
Figure 4:
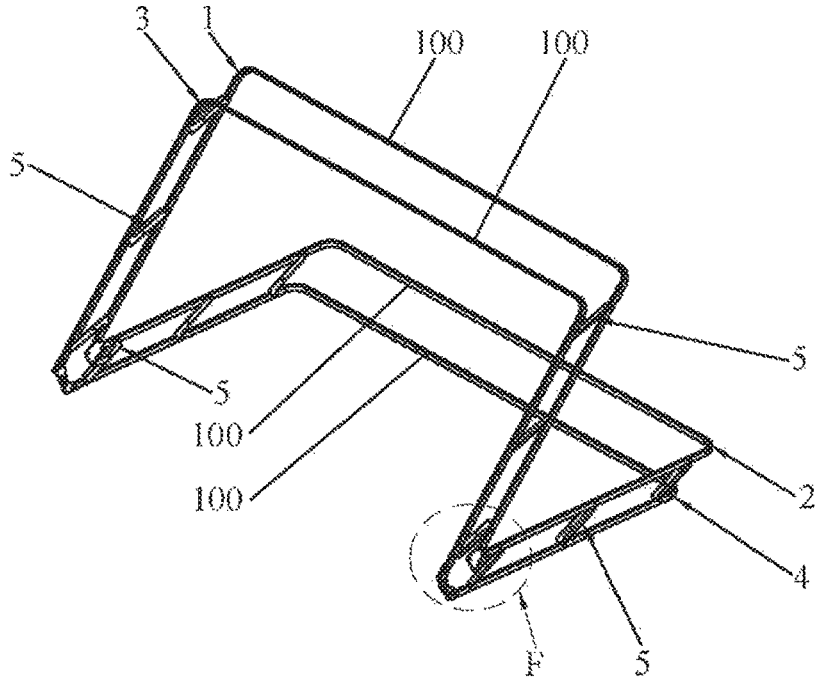
FIG. 4 is a schematic perspective view illustrating a foldable supporting frame in a third folded state in accordance with some embodiments of the present invention.
Figure 4A:
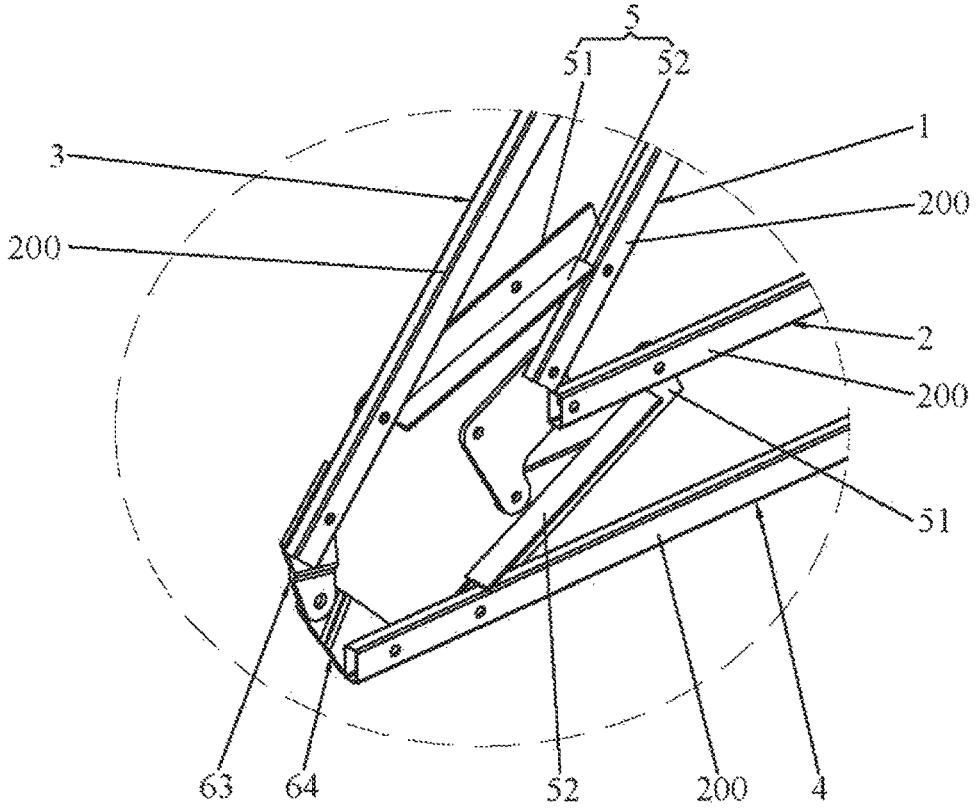
FIG. 4A is an enlarged view of circle F in FIG. 4 illustrating a first exemplary folding mechanism in accordance with some embodiments of the present invention.

Continuously referring to FIGS. 1-5A, the plurality of first exemplary supports 5 are disposed between the upper frame and the lower frame of the foldable supporting frame formed by the plurality of bent bars. In some embodiments, the plurality of supports are disposed between longitudinal part 200 of first bent bar 1 and corresponding longitudinal part 200 of third bent bar 3, and between longitudinal part 200 of second bent bar 2 and corresponding longitudinal part 200 of fourth bent bar 4, as illustrated in FIGS. 2 and 3. In some embodiments, the supports are disposed evenly within one pair of longitudinal parts (e.g., one longitudinal part 200 of first bent bar 1 and one corresponding longitudinal part 200 of third bent bar 3) along the longitudinal direction of the supporting frame.

Referring in particular to FIGS. 1A-1E, in some embodiments, first exemplary support 5 includes supporting piece 51 and restraining piece 52 extended from the supporting piece and bent at a predetermined angle with respect to the supporting piece. In a preferred embodiment, supporting piece 51 and restraining piece 52 are perpendicular or substantially perpendicular to each other. Restraining piece 52 can be formed on either side (e.g., left and right sides) of supporting piece 51. For example, support 5 on the left hand side of FIG. 1B has restraining piece 52 formed on the right side of supporting piece 51 and support 5 on the right hand side of FIG. 1B has restraining piece 52 formed on the left side of supporting piece 51. Restraining piece 52 includes first surface 521 and second surface 522.

Supporting piece 51 has first part 511 and second part 512. In a preferred embodiment, first part 511 includes a substantially horizontally extended first pivotal portion such as first pivotal portion 5111 illustrated in FIG. 1C. Second part 512 includes a substantially vertically extended second pivotal portion 5121. In some embodiments, restraining piece 52, first pivotal portion 5111 and second pivotal portion 5121 are perpendicular or substantially perpendicular to each other.

Figure 1C:
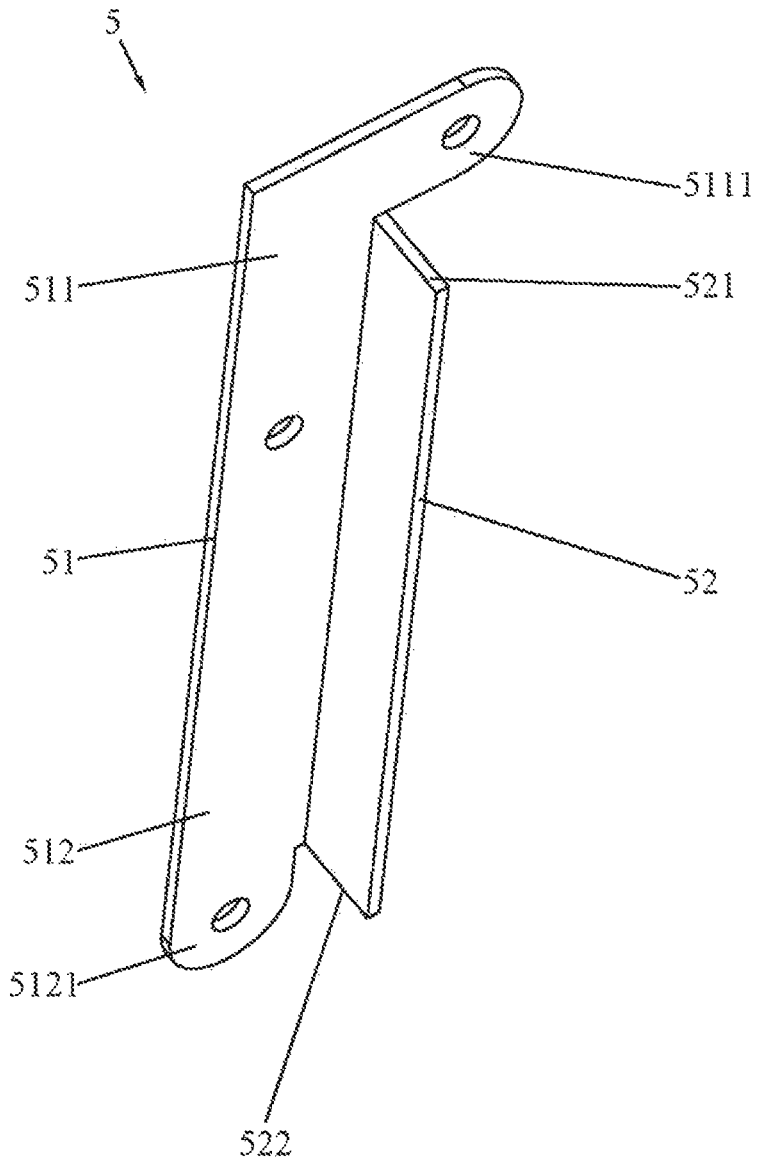
FIG. 1C is a perspective view illustrating a first exemplary support in accordance with some embodiments of the present invention.
Figure 1D:
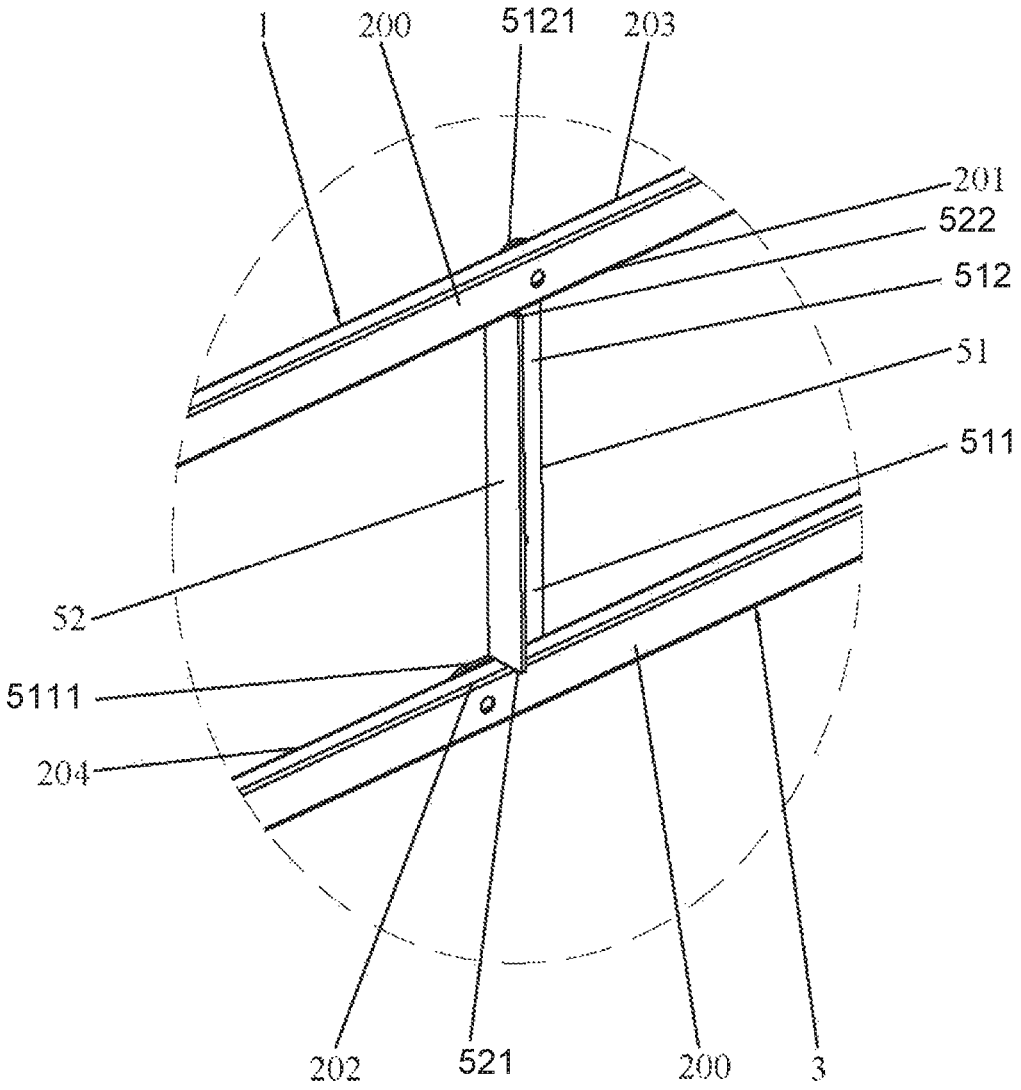
FIG. 1D is an enlarged view of circle C3 in FIG. 1 illustrating a first exemplary support in accordance with some embodiments of the present invention.
Figure 1E:
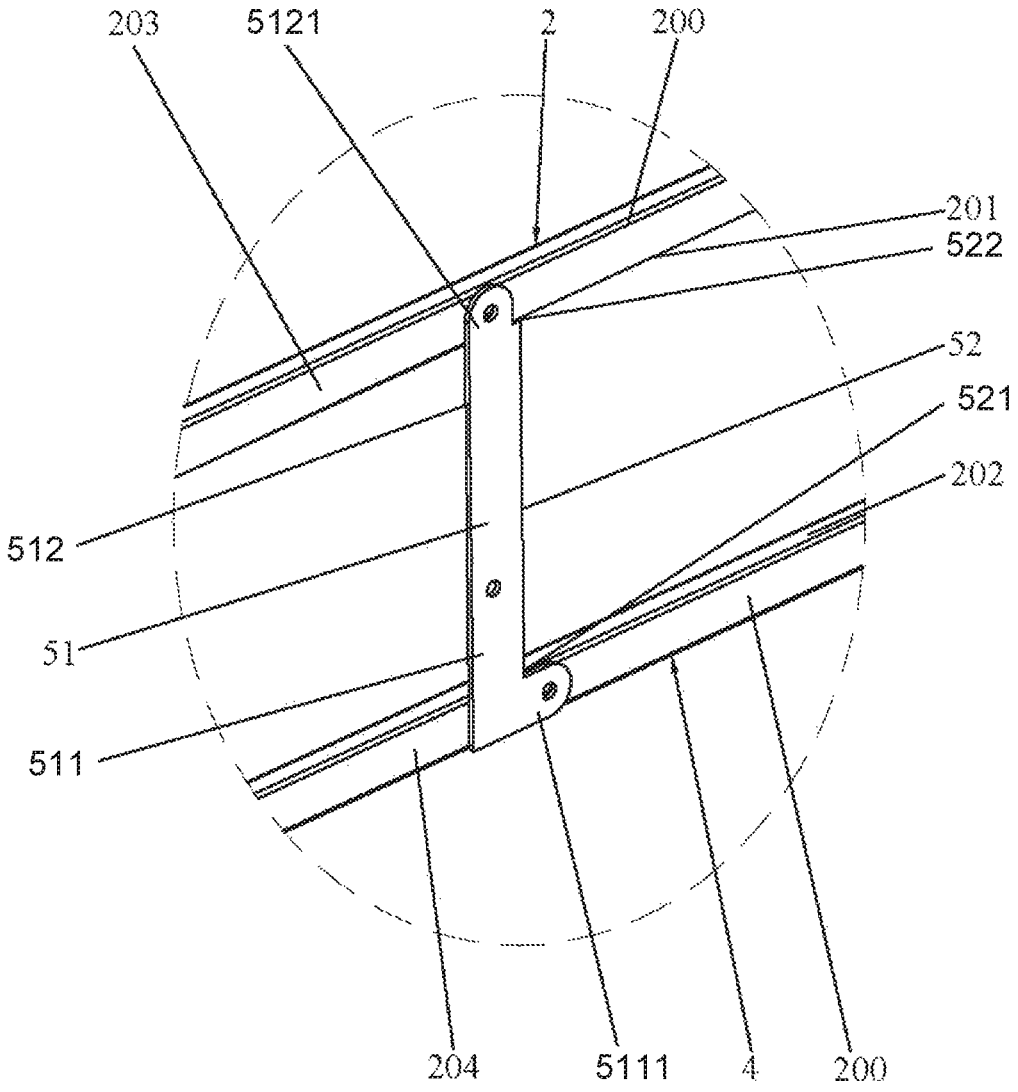
FIG. 1E is an enlarged view of circle C4 in FIG. 1 illustrating a first exemplary support in accordance with some embodiments of the present invention.

In some embodiments, first part 511 is configured such that it can be pivotally connected to either the upper frame or the lower frame of the supporting frame through first pivotal portion 5111. For instance, FIGS. 1C and 1B illustrate first part 511 of support 5 pivotally connected to the upper frame, and FIGS. 1D and 1E illustrate first part 511 of support 5 pivotally connected to the lower frame. Similarly, in some embodiments, second part 512 is configured such that it can be pivotally connected to either the upper frame or the lower frame of the supporting frame through second pivotal portion 5121 as illustrated in FIGS. 1A, 1B, 1D and 1E. In one embodiment, supports 5 are oriented such that first parts 511 of all supports are connected to the upper frame and corresponding second parts 512 are connected to the lower frame of a supporting frame. In another embodiment, supports 5 are oriented such that first parts 511 of all supports are connected to the lower frame and corresponding second parts 512 are connected to the upper frame of a supporting frame. In still another embodiment, at least one support 5 is oriented with first part 511 connected to the upper frame and corresponding second part 512 connected to the lower frame; and at least one support 5 is oriented with first part 511 connected to the lower frame and second part 512 connected to the upper frame.

In a preferred embodiment, first pivotal portion 5111 and second pivotal portion 5121 of supporting piece 51 are in surface contact with side surfaces of the upper and lower frames and pivotally connected to the upper and lower frames. For instance, in the embodiments illustrated in FIGS. 1D-1E, first pivotal portion 5111 of supporting piece 51 is in surface contact with side surface 204 of lower frame 4 and pivotally connected to lower frame 4. Second pivotal portion 5121 of supporting piece 51 is in surface contact with side surface 203 of upper frame 3 and pivotally connected to upper frame 3. As such, first pivotal portion 5111 and second pivotal portion 5121 of supporting piece 51 guide and restrain rotation of the bent bars. This reduces or eliminates sway, offset or any undesired movement of bent bars when folding or unfolding the supporting frame, and thus increases effectiveness, efficiency and accuracy of folding and unfolding the supporting frame.

When the foldable supporting frame is unfolded (e.g., when in use), one of the surfaces of the restraining piece (e.g., first surface 521 or second surface 522 depending on the orientation of the support) is below the upper frame of the foldable supporting frame and in direct contact with the lower surface of the upper frame. For instance, in the embodiments illustrated in FIGS. 1D-1E, second surface 522 of the restraining piece is below upper frame 2 of the foldable supporting frame and in direct contact with lower surface 201 of the upper frame. As such, the plurality of first exemplary supports 5 supports the upper frame and prevents the upper frame from any undesired movement (e.g., further unfolding, collapsing, swaying) when the supporting frame is unfolded (e.g., in use).

In some embodiments, when unfolded, one of the surfaces of the restraining piece (e.g., first surface 521 or second surface 522 depending on the orientation of the support) is above the lower frame of the foldable supporting frame and in direct contact with the upper surface of the lower frame. For instance, in the embodiments illustrated in FIGS. 1D-1E, first surface 521 of the restraining piece is above lower frame 4 of the foldable supporting frame and in direct contact with upper surface 202 of the lower frame. As such, the plurality of first exemplary supports 5 helps to maintain the upper and lower frames to be substantially flat and substantially parallel to each other when the supporting frame is unfolded.

On the other hand, as illustrated in FIG. 5, when the supporting frame is folded (e.g., for packaging), the plurality of first exemplary supports 5 and first exemplary folding mechanisms allow each of the first, second, third and fourth bent bar to fold toward each other, with the first and second bent bars in the middle. In some embodiments, when folded, third bent bar 3 and fourth bent bar 4 are parallel or substantially parallel to each other. As a result, the folded supporting frame is more compact and better for packaging, storing, shipping and transportation.

Turning now to FIGS. 6-10A, in some embodiments, a foldable supporting frame of the present invention includes a plurality of bent bars, such as first bent bar 1', second bent bar 2', third bent bar 3' and fourth bent bar 4'. First bent bar 1', second bent bar 2', third bent bar 3' and fourth bent bar 4' are the same or similar to first bent bar 1, second bent bar 2, third bent bar 3 and fourth bent bar 4 illustrated in FIGS. 1-5A. In some embodiments, first bent bar 1', second bent bar 2', third bent bar 3' and fourth bent bar 4' are made to be the same or substantially the same as each other. In some embodiments, each of the first, second, third and fourth bent bars includes lateral part 100' and two longitudinal parts 200' each extended longitudinally from one end of lateral part 100'.

Similar to the embodiments illustrated in FIGS. 1-5A, the plurality of bent bars are selectively and pivotally connected to each other by a plurality of second exemplary folding mechanisms 6' to form an upper frame such as upper frame 1-2' and a lower frame such as lower frame 3-4'. In various embodiments, the foldable supporting frame also includes a plurality of second exemplary supports 5' disposed between the upper and lower frames and pivotally connected to the upper and lower frames.

In the illustrated embodiments, the supporting frame includes two second exemplary folding mechanisms 6', one shown in circle C1' and the other in circle C2'. Enlarged views of these folding mechanisms 6' are shown in FIGS. 6A and 6B. In one embodiment, the two folding mechanisms are identical or substantially identical to each other. In another embodiment, the two folding mechanisms are reflection-symmetric or mirror-symmetric to each other.

In various embodiments, folding mechanism 6' includes first link 61' having left upper part 611' pivotally connected to free end 11' of first bent bar 1' and right upper part 612' pivotally connected to free end 21' of second bent bar 2'. The connected first and second bent bars collectively form upper frame 1-2' of the foldable supporting frame. In some embodiments, first link 61' includes link body piece 61*a*' with left upper part 611' and right upper part 612'.

In some embodiments, folding mechanism 6' further includes second link 63' and third link 64', with the lower part 631' of second link 63' fixedly connected to the free end of third bent bar 3' and the lower part 641' of third link 64' fixedly connected to the free end of fourth bent bar 4'. Unlike first link 61 of first exemplary folding mechanism 6, the lower part 613' of first link 61' is pivotally connected to the upper part 632' of second link 63' and the upper part 642' of third link 64'. The connected third and fourth bent bars thus collectively form lower frame 3-4' of the foldable supporting frame. In one embodiment, second link 63' and third link 64' are positioned substantially symmetrically with respect to each other.

In some embodiments, pivot points, at which first link 61' connects with first bent bar 1', with second bar 2' and with second link 63' and third link 64', are positioned triangularly, forming a triangular structure 62'. Such positioning of the pivot points ensures the coordination among the bent bars and prevents sways, offsets or other undesired movements of the bent bars, and thus improves the stability of folding and unfolding the supporting frame. In some embodiments, a pivot point at which first link 61' connects with first bent bar 1' and a pivot point at which first link 61' connects with second bar 2' are positioned substantially symmetrically with respect to a pivot point at which first link 61' with second link 63' and third link 64'.

In some embodiments, second link 63' is the same as or similar to second link 63 and third link 64' is the same as or similar to third link 64 of first folding mechanism 6 disclosed herein and illustrated in FIGS. 1-5A. For example, referring to FIGS. 6A, 7A, 8A, 9A and 10A, in some embodiments, second link 63' is bent between the upper part and the lower part, creating one bending structure 65' in which the upper part forms recessed step 66' with respect to the lower part of second link 63'. Similarly, third link 64 is bent between the upper part and the lower part, creating another bending structure 65' in which the upper part forms recessed step 66' with respect to the lower part of third link 64'. In such embodiments, second link 63' and third link 64' are pivotally connected to each other at pivot point 67' located within the recessed steps of second link 63' and third link 64'. The recessed steps of second link 63' and third link 64' are in surface contact with each other. The contacting surfaces of the recessed steps guide and restrain rotation of second link 63' and third link 64', and thence guide and restrain rotation of the first, second, third and fourth bent bars. This reduces or eliminates sway, offset or any undesired movement of bent bars when folding or unfolding the supporting frame, and thus increases effectiveness, efficiency and accuracy of folding and unfolding the supporting frame. In addition, bending structures 65' enhance the strength and prolong the lifetime of second link 63' and third link 64'.

Like second link 63 and third link 64 disclosed herein and illustrated in FIGS. 1-5A, in a preferred embodiment, bending edges 651' of second link 63' and third link 64' are slanted with respect to a horizontal line or corresponding bent bars when the foldable supporting frame is unfolded. Second link 63' and third link 64' are positioned and pivotally connected in such a way that bending edges 651' assist in guiding rotation of second link 63' and third link 64'. This further increases folding/unfolding effectiveness, efficiency and accuracy of the supporting frame.

Figure 6:
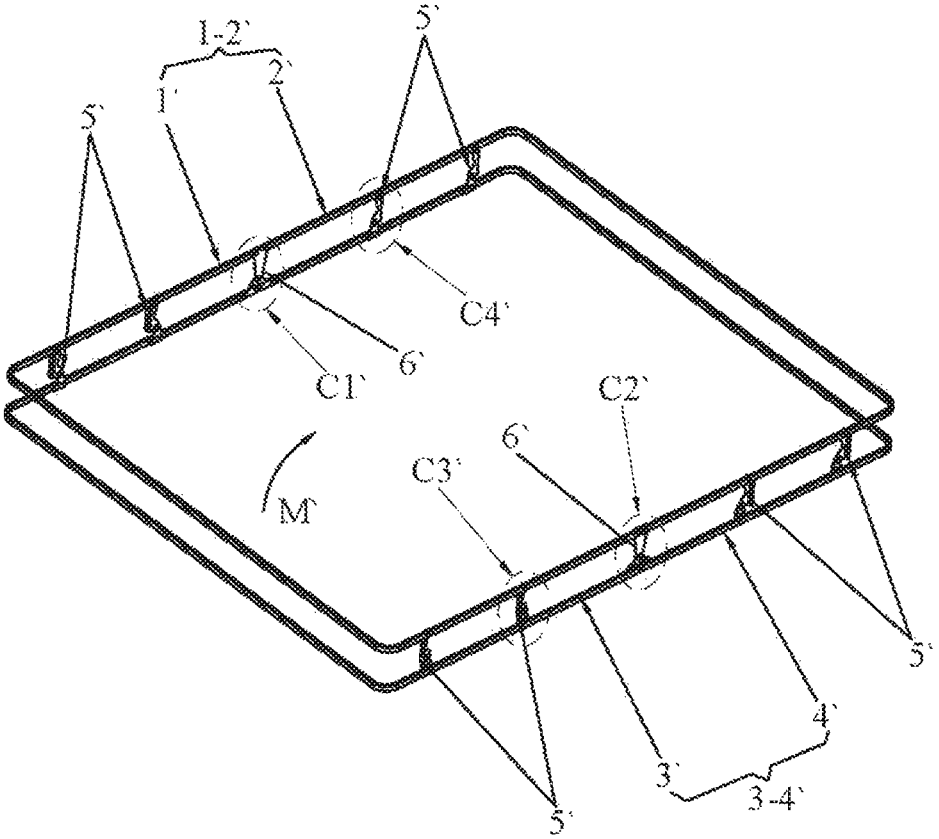
FIG. 6 is a schematic perspective view illustrating a foldable supporting frame in an unfolded state in accordance with some embodiments of the present invention.
Figure 6A:
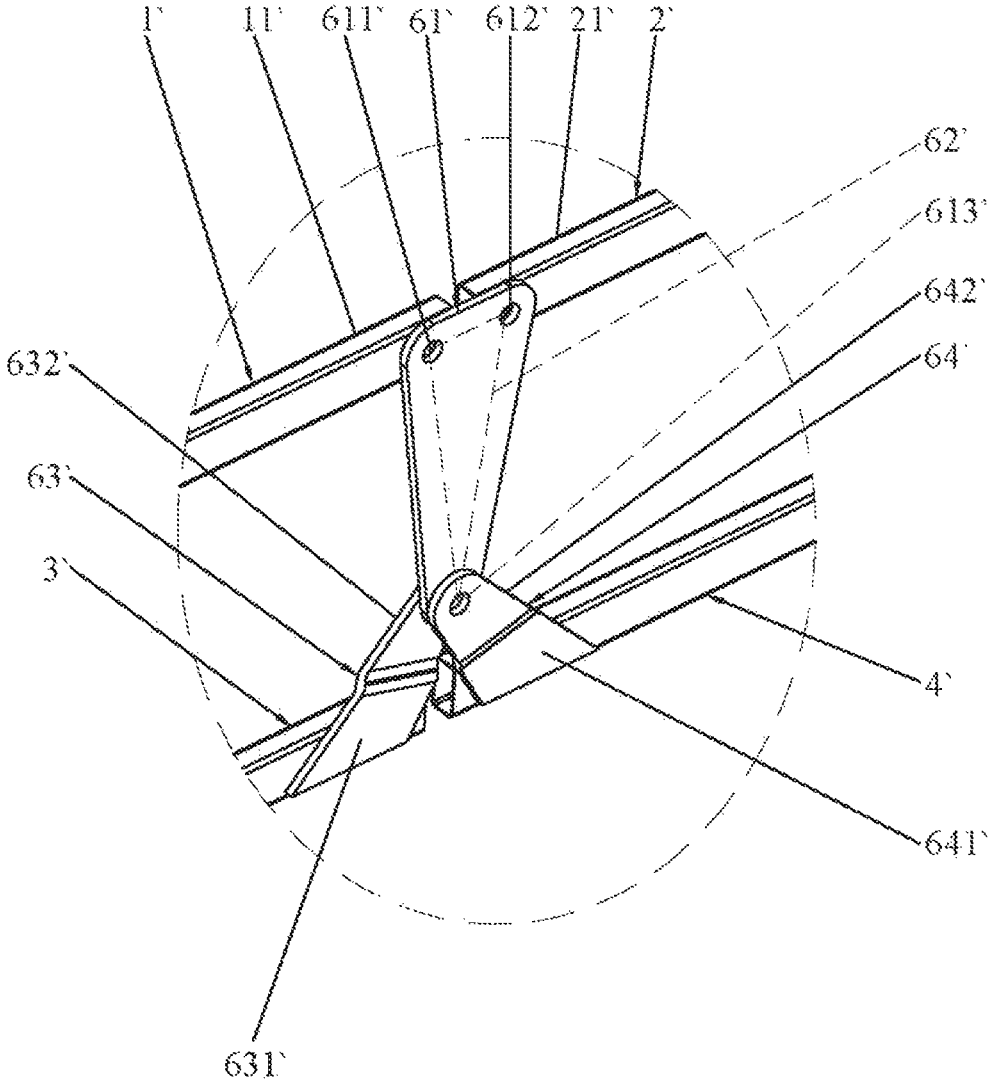
FIG. 6A is an enlarged view of circle C1' in FIG. 6 illustrating a second exemplary folding mechanism in accordance with some embodiments of the present invention.
Figure 6B:
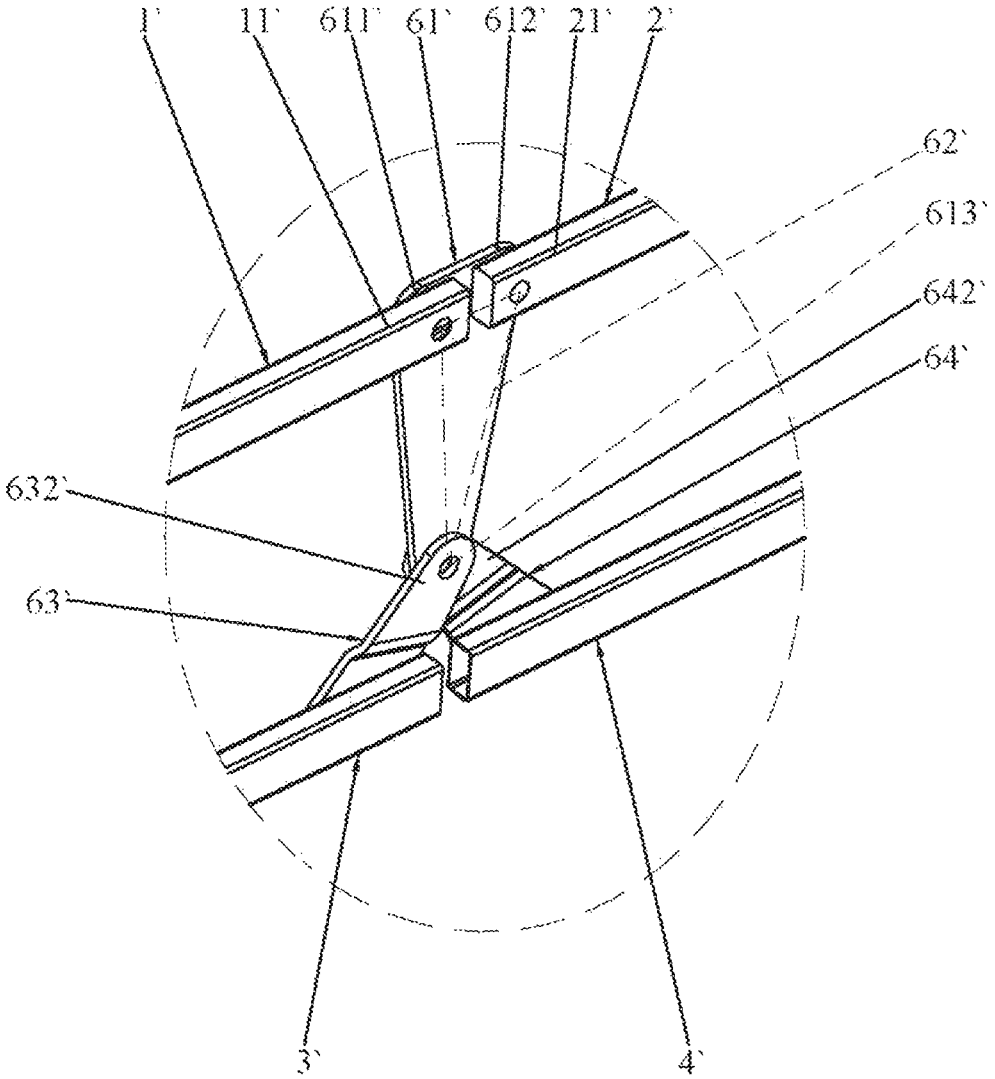
FIG. 6B is an enlarged view of circle C2' in FIG. 6 illustrating a second exemplary folding mechanism in accordance with some embodiments of the present invention.
Figure 7:
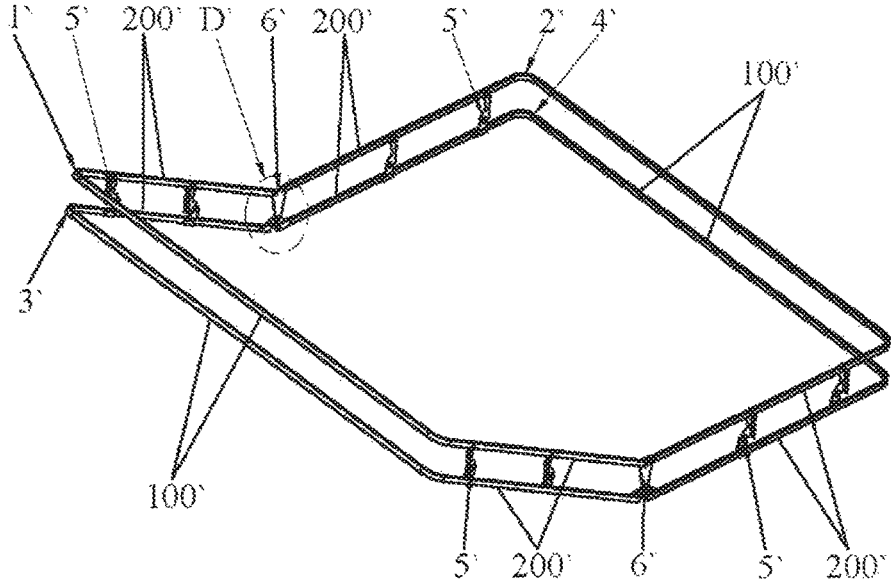
FIG. 7 is a schematic perspective view illustrating a foldable supporting frame in a first folded state in accordance with some embodiments of the present invention.
Figure 7A:
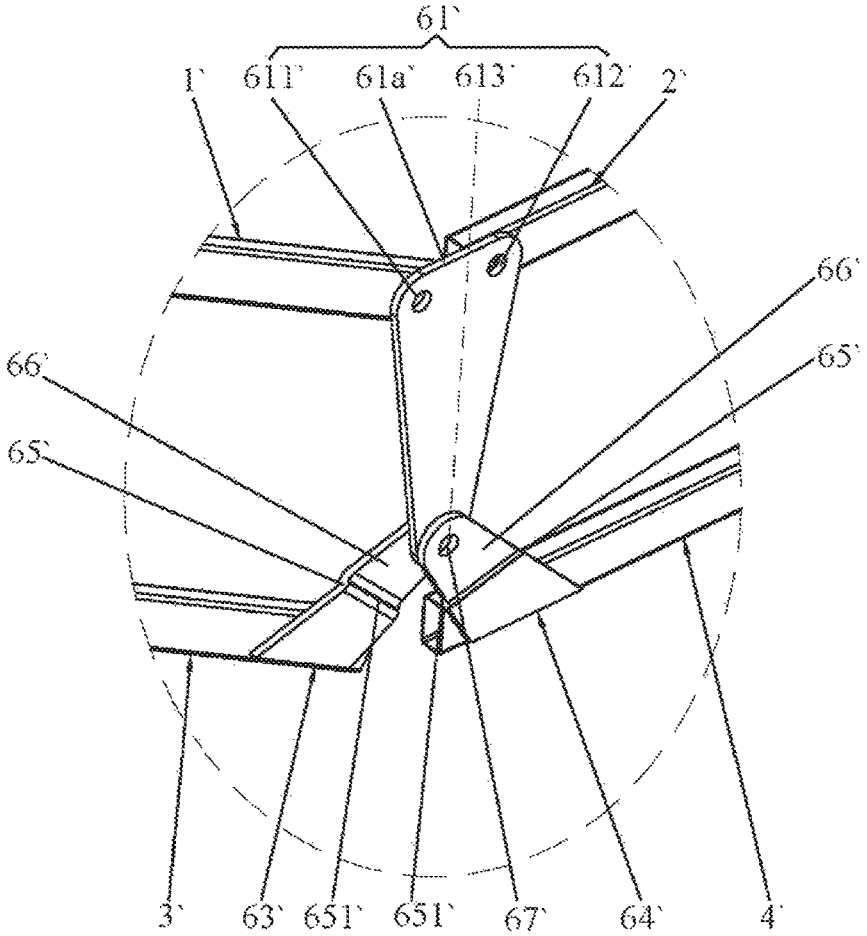
FIG. 7A is an enlarged view of circle D' in FIG. 7 illustrating a second exemplary folding mechanism in accordance with some embodiments of the present invention.
Figure 8:
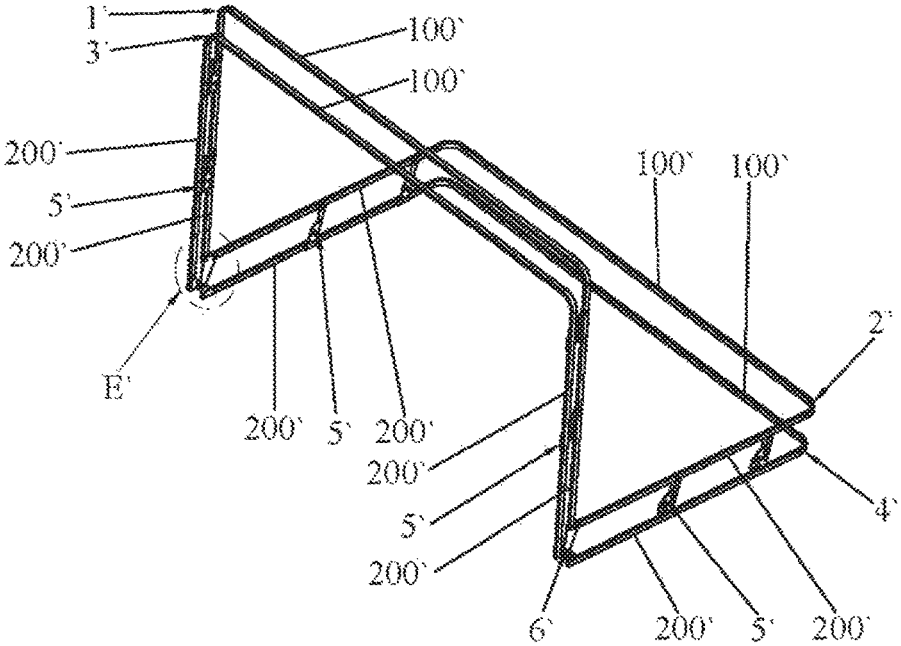
FIG. 8 is a schematic perspective view illustrating a foldable supporting frame in a second folded state in accordance with some embodiments of the present invention.
Figure 8A:
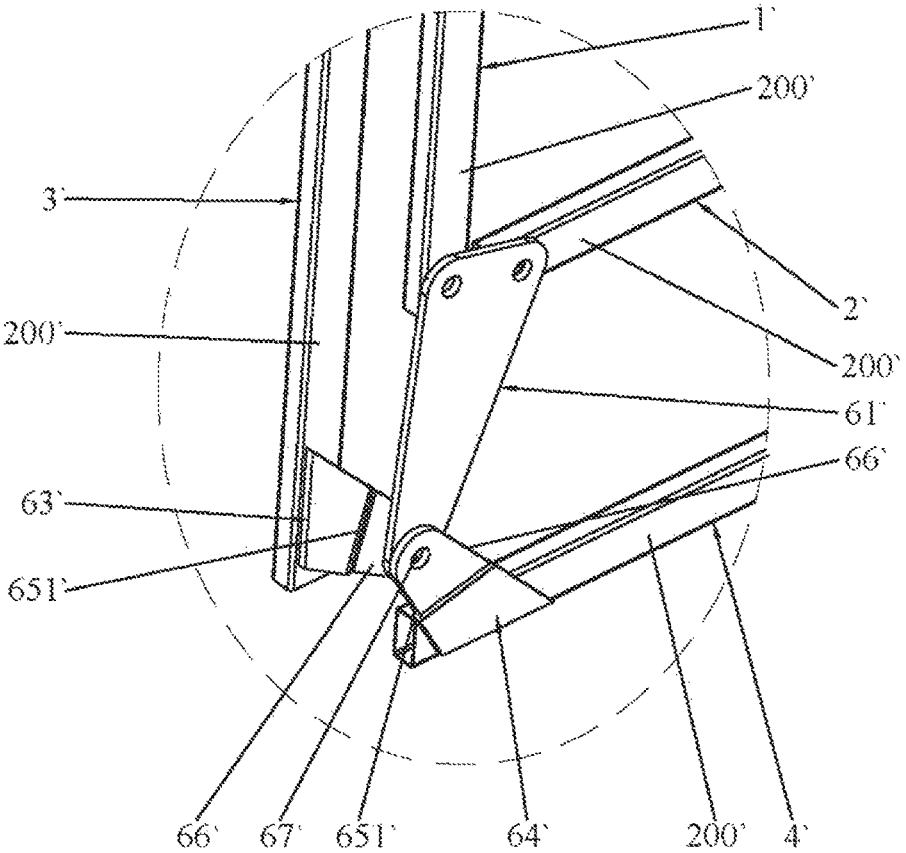
FIG. 8A is an enlarged view of circle E' in FIG. 8 illustrating a second exemplary folding mechanism in accordance with some embodiments of the present invention.
Figure 9:
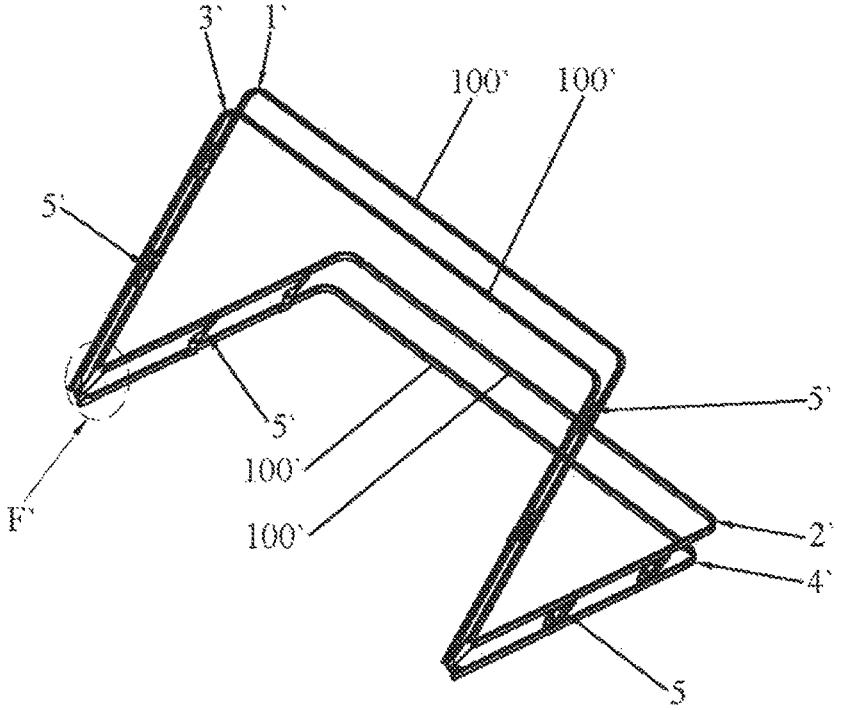
FIG. 9 is a schematic perspective view illustrating a foldable supporting frame in a third folded state in accordance with some embodiments of the present invention.
Figure 9A:
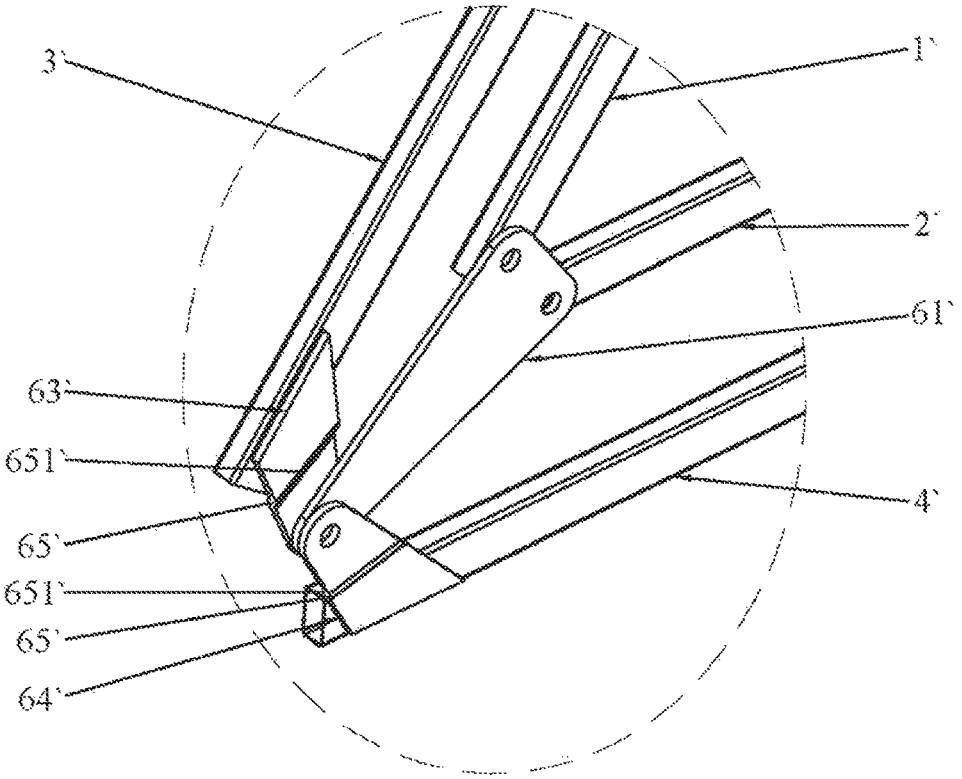
FIG. 9A is an enlarged view of circle F' in FIG. 9 illustrating a second exemplary folding mechanism in accordance with some embodiments of the present invention.

Continuously referring to FIGS. 6-10A, the plurality of second exemplary supports 5' are disposed between the upper frame and the lower frame of the supporting frame formed by the plurality of bent bars. In some embodiments, the plurality of supports are disposed between longitudinal part 200' of first bent bar 1' and corresponding longitudinal part 200' of third bent bar 3', and between longitudinal part 200' of second bent bar 2' and corresponding longitudinal part 200' of fourth bent bar 4', as illustrated in FIGS. 6 and 7. In some embodiments, the supports are disposed evenly within one pair of longitudinal parts (e.g., one longitudinal part 200' of first bent bar 1' and one corresponding longitudinal part 200' of third bent bar 3') along the longitudinal direction of the supporting frame.

Figure 6C:
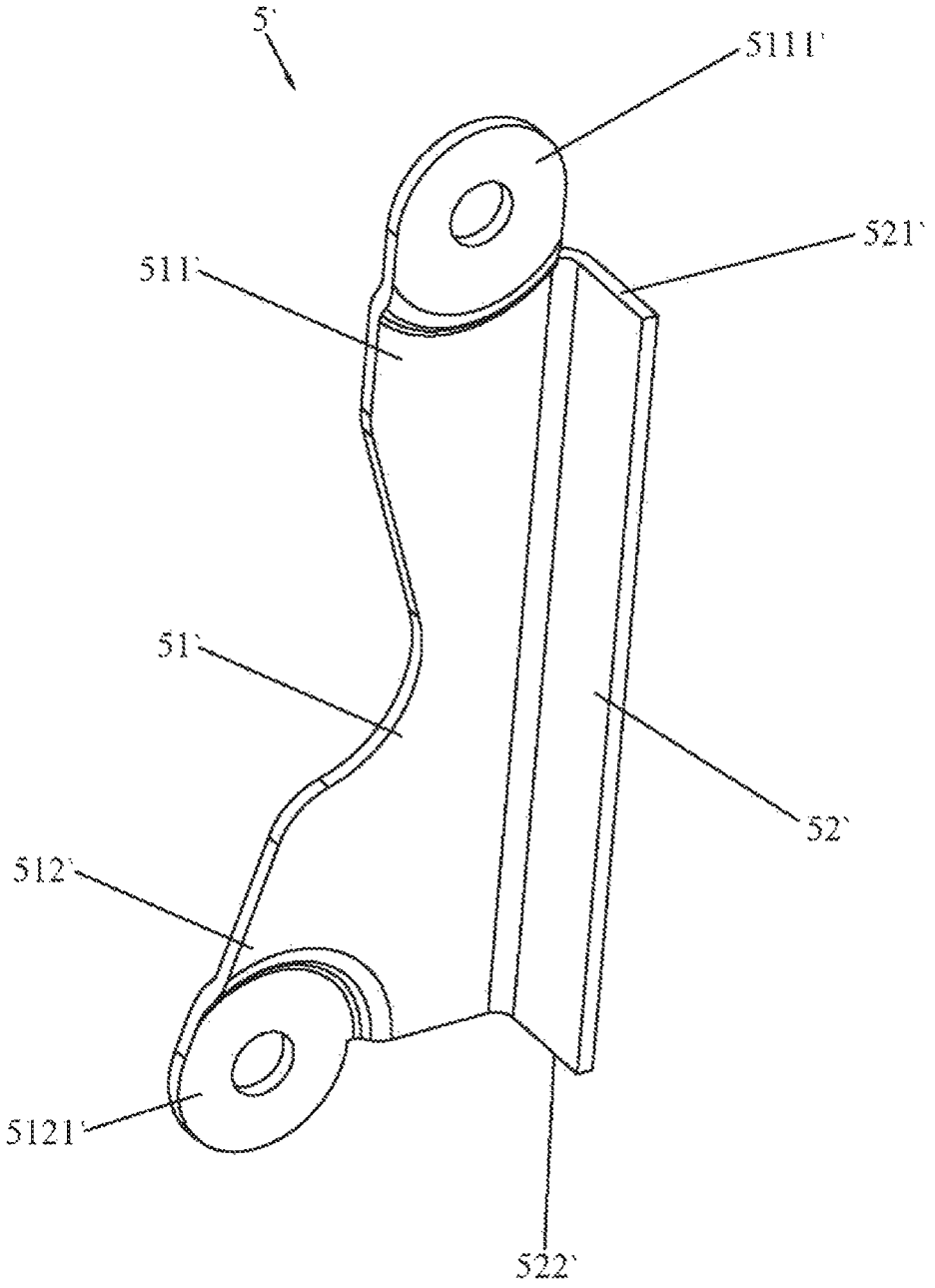
FIG. 6C is a perspective view illustrating a second exemplary support in accordance with some embodiments of the present invention.
Figure 6D:
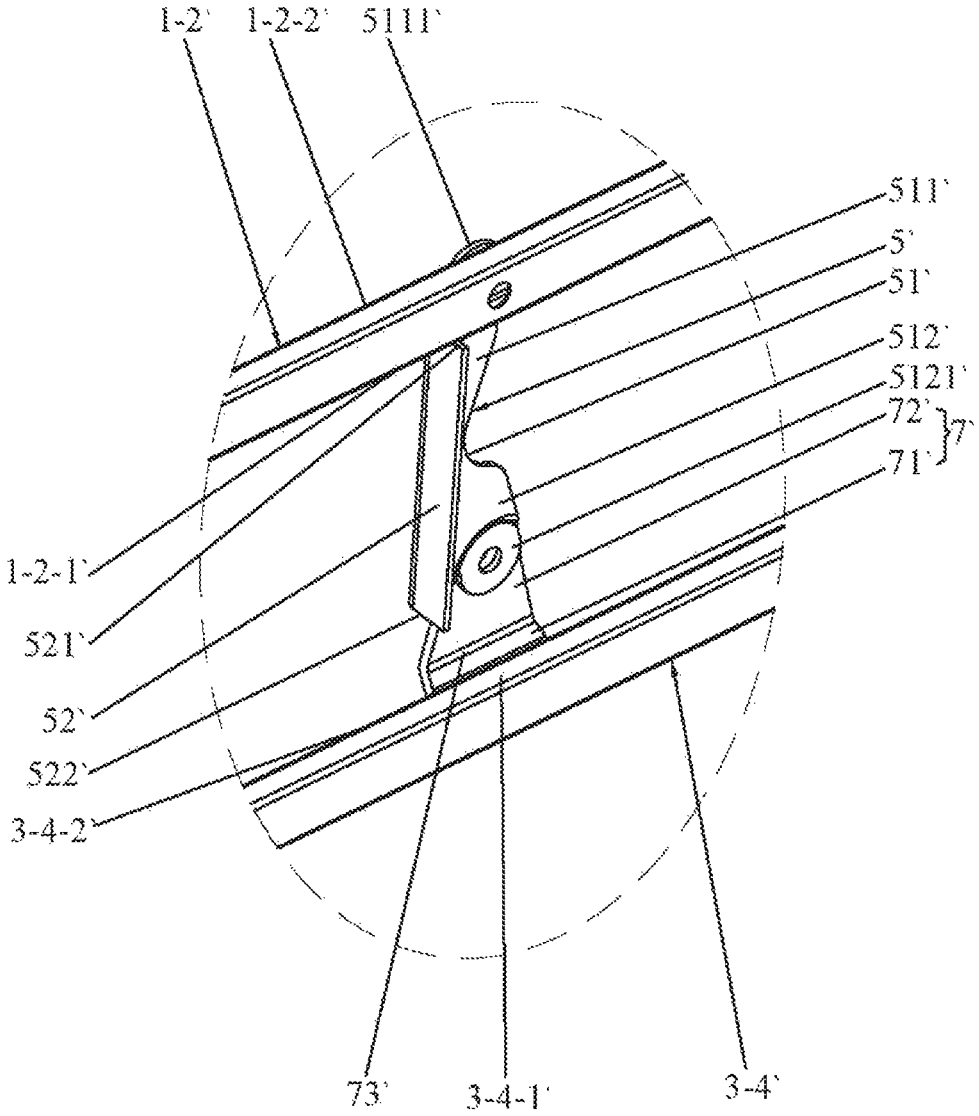
FIG. 6D is an enlarged view of circle C3' in FIG. 6 illustrating a second exemplary support in accordance with some embodiments of the present invention.
Figure 6E:
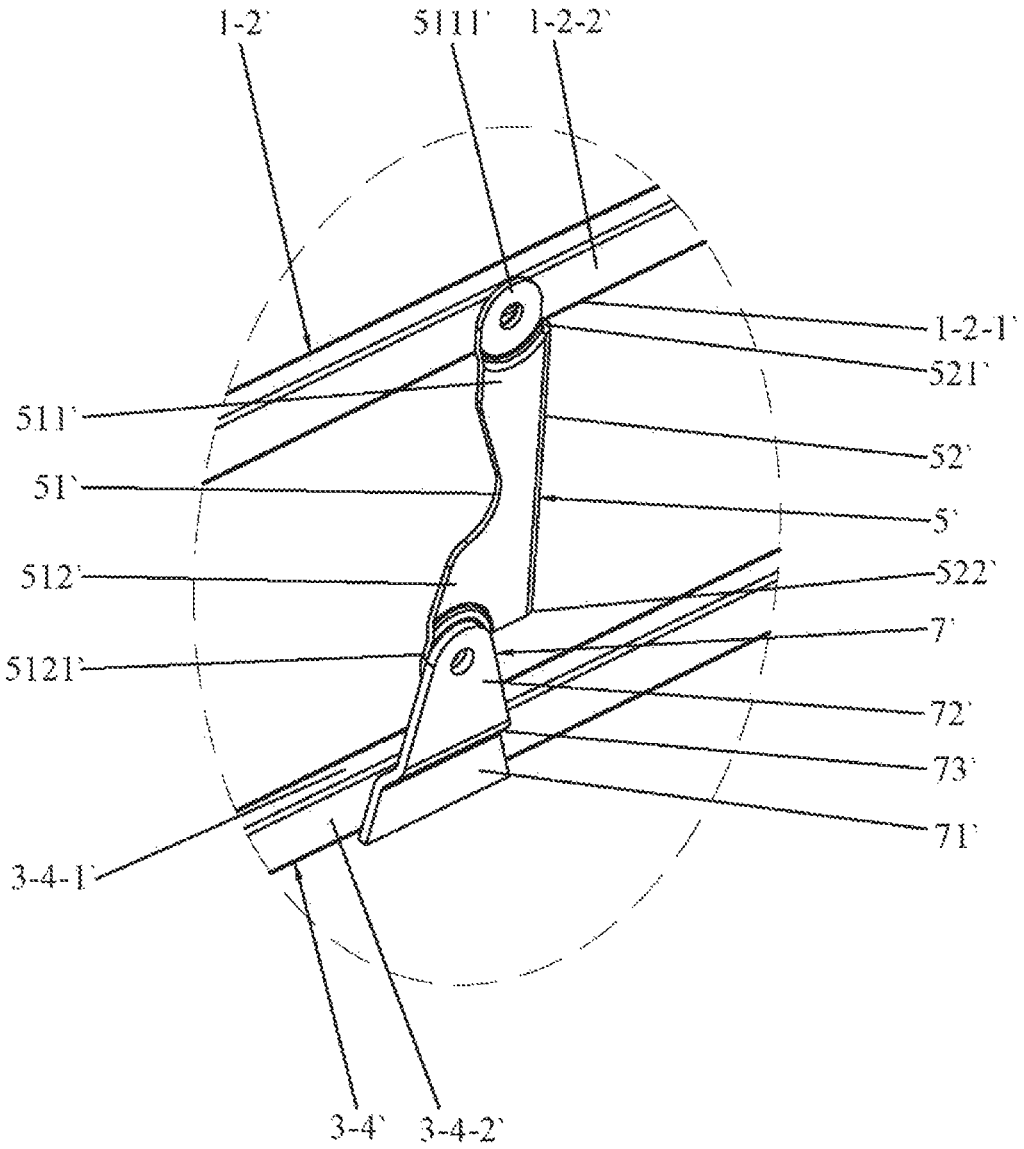
FIG. 6E is an enlarged view of circle C4' in FIG. 6 illustrating a second exemplary support in accordance with some embodiments of the present invention.

Referring in particular to FIGS. 6C-6E, in some embodiments, second exemplary support 5' includes supporting piece 51' and restraining piece 52' extended from the supporting piece and bent at a predetermined angle with respect to the supporting piece. In a preferred embodiment, supporting piece 51' and restraining piece 52' are perpendicular or substantially perpendicular to each other. Supporting piece 51' has first part 511' and second part 512'. Restraining piece 52' includes first surface 521' and second surface 522'.

In some embodiments, second exemplary support 5' further includes a connecting piece such as connecting piece 7' illustrated in FIGS. 6D and 6E. Connecting piece 7' has upper part 72' and lower part 71'. In such embodiments, first part 511' of supporting piece 51' is pivotally connected to upper frame 1-2' of the supporting frame, and second part 512' of supporting piece 51' is pivotally connected to upper part 72' of connecting piece 7'. Lower part 71' of connecting piece 7' is fixedly coupled to lower frame 3-4' of the supporting frame. In a preferred embodiment, connecting piece 7' is substantially perpendicular to lower frame 3-4' of the supporting frame. In an embodiment, lower frame 3-4' of the supporting frame has upper surface 3-4-1' and side surface 3-4-2'. In an embodiment, lower part 71' of connecting piece 7' is fixedly coupled to side surface 3-4-2' of lower frame 3-4' of the supporting frame.

In some embodiments, connecting piece 7' is bent between upper part 72' and lower part 71', creating bending structure 73'. Bending structure 73' makes it easier to fix lower part 71' of connecting piece 7' on the lower frame of the supporting frame, and enhances the strength and prolongs the lifetime of connecting piece 7'.

In a preferred embodiment, first part 511' of supporting piece 51' is extended and/or bent in accordance with the upper frame, e.g., toward side surface 1-2-2' of upper frame 1-2', to form first pivotal portion 5111'. First pivotal portion 5111' of supporting piece 51' and side surface 1-2-2' of upper frame 1-2' are in surface contact with and pivotally connected to each other. As such, first pivotal portion 5111' of supporting piece 51' guides and restrains rotation of the bent bars of upper frame 1-2'. This reduces or eliminates sway, offset or any undesired movement of bent bars when folding or unfolding the supporting frame, and thus increases effectiveness, efficiency and accuracy of folding and unfolding the supporting frame.

In a preferred embodiment, second part 512' of supporting piece 51' is extended and/or bent in accordance with upper part 72' of connecting piece 7', e.g., toward a side surface of upper part 72' of connecting piece 7', to form second pivotal portion 5121'. Second pivotal portion 5121' of supporting piece 51' and the side surface of upper part 72' of connecting piece 7' are in surface contact with and pivotally connected to each other. Since lower part 71' of connecting piece 7' is fixedly connected to the lower frame of the supporting frame, second pivotal portion 5121' of supporting piece 51' guides and restrains rotation of the bent bars of lower frame 3-4'. This further reduces or eliminates sway, offset or any undesired movement of bent bars when folding or unfolding the supporting frame, and thus increases effectiveness, efficiency and accuracy of folding and unfolding the supporting frame.

When the foldable supporting frame is unfolded (e.g., when in use), first surface 521' of the restraining piece is below upper frame 1-2' of the foldable supporting frame and in direct contact with lower surface 1-2-1' of upper frame 1-2'. As such, the plurality of second exemplary supports 5' supports the upper frame and prevents the upper frame from any undesired movement (e.g., further unfolding, collapsing, swaying) when the supporting frame is unfolded (e.g., in use). In some embodiments, the plurality of s71' cond exemplary support 5' helps to maintain the upper frame and lower frame to be substantially flat and substantially parallel to each other when the supporting frame is unfolded.

Figure 10:
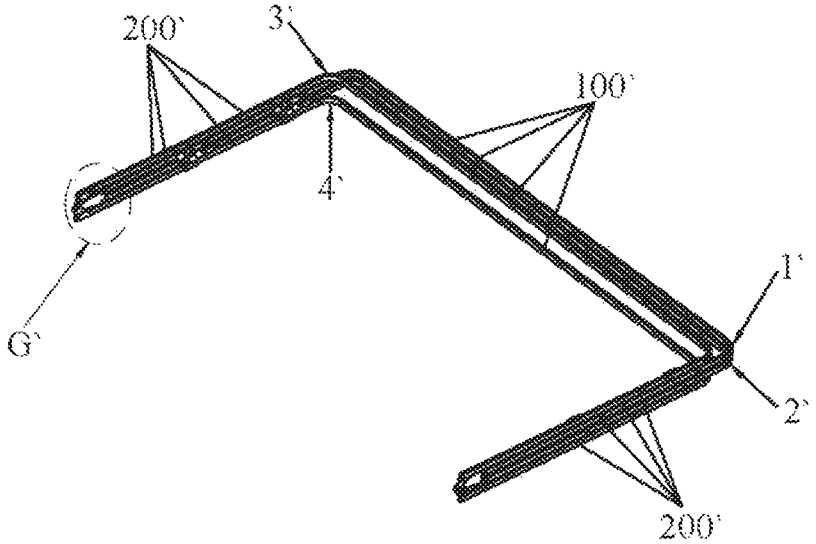
FIG. 10 is a schematic perspective view illustrating a foldable supporting frame in a fourth folded state in accordance with some embodiments of the present invention.
Figure 10A:
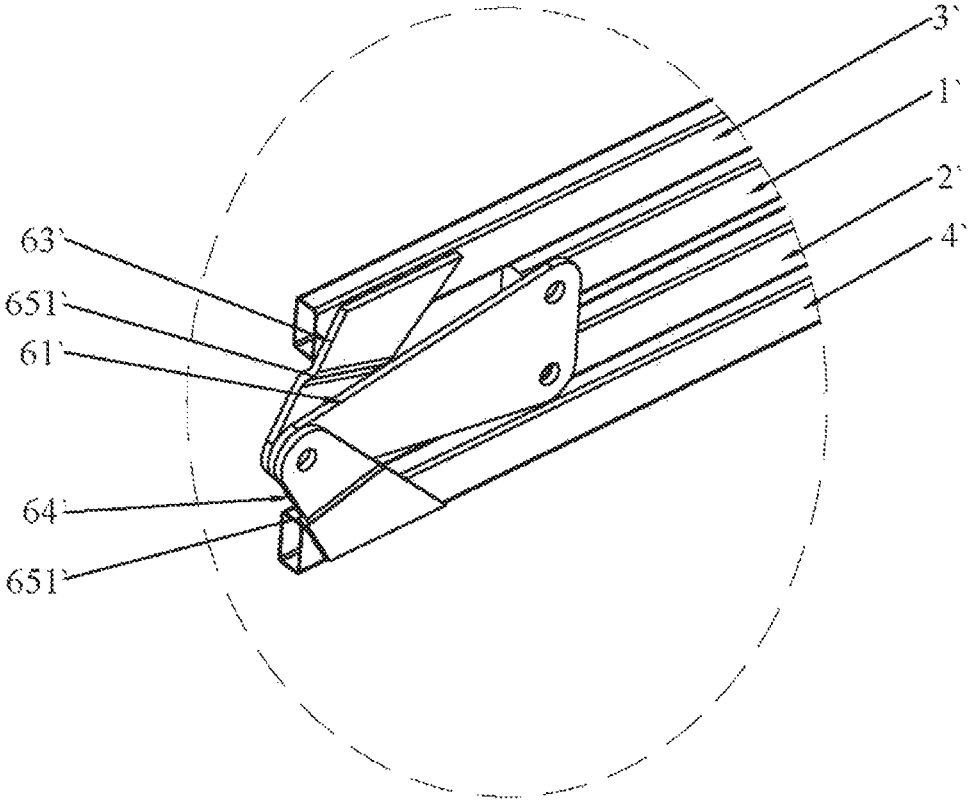
FIG. 10A is an enlarged view of circle G' in FIG. 10 illustrating a second exemplary folding mechanism in accordance with some embodiments of the present invention.

On the other hand, as illustrated in FIG. 10, when the supporting frame is folded (e.g., for packaging), the plurality of second exemplary supports 5' and second exemplary folding mechanisms 6' allow each of the first, second, third and fourth bent bar to fold toward each other, with the first and second bent bars in the middle. In some embodiments, when folded, third bent bar 3' and fourth bent bar 4' are parallel or substantially parallel to each other. As a result, the folded supporting frame is more compact and better for packaging, storing, shipping and transportation.

Figure 11A:
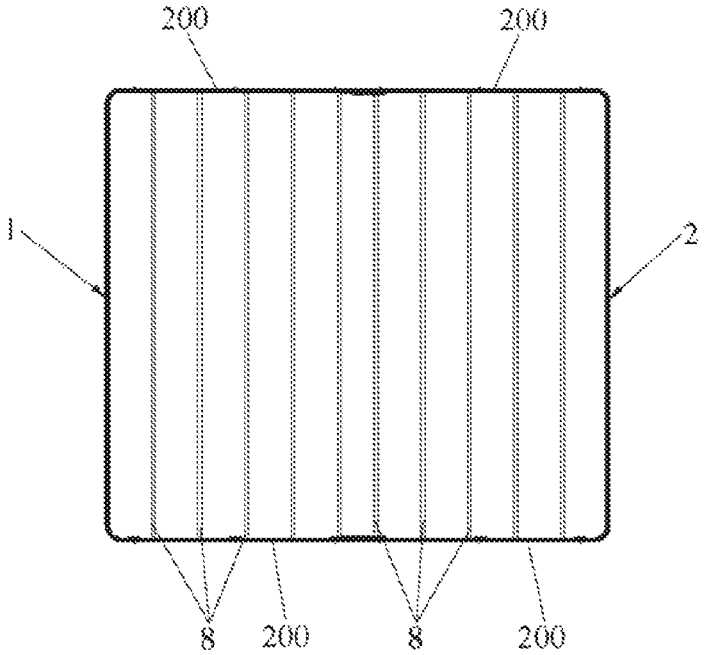
FIG. 11A is a schematic top view illustrating a foldable supporting frame in an unfolded state in accordance with some embodiments of the present invention.
Figure 11B:
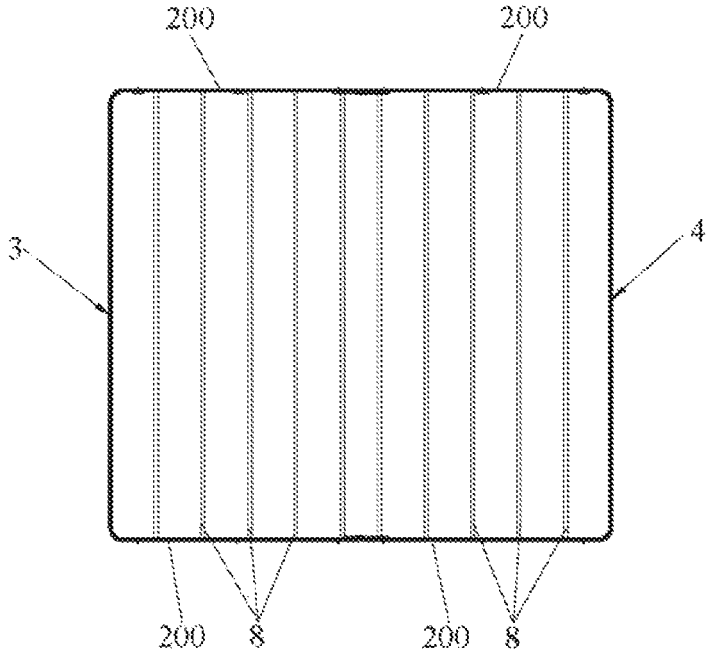
FIG. 11B is a schematic bottom view illustrating a foldable supporting frame in an unfolded state in accordance with some embodiments of the present invention.

In some embodiments, the foldable supporting frames include additional or optional components. For example, as illustrated in FIGS. 11A and 11B, a foldable supporting frame includes a plurality of crossbars 8, each having two ends. In a preferred embodiment, crossbar 8 is disposed laterally with the two ends connected to longitudinal parts 200 of a bent bar.

Supports, folding mechanisms and foldable supporting frames of the present invention have a number of advantages. For instance, the foldable supporting frames of the present invention can be used alone or in conjunction with bed frames to increase the heights of the beds to accommodate users' different heights or personal preferences. A foldable frame of the present invention includes a plurality of bent bars pivotally connected to each other through folding mechanisms and/or supports. Accordingly, the foldable frame can be folded or unfolded by rotating any one of the bent bars, making it easier to handle and use. Moreover, rotation of the bent bars are guided and restrained by the folding mechanisms and/or supports, effectively reducing or eliminating sway, offset or any undesired movement of the bent bars and improving efficiency and accuracy of folding/unfolding the supporting frame. Further, when the supporting frame is unfolded or in use, the supports hold the upper frame and prevent it from further unfolding, collapsing, swaying or any undesired movement. In various cases, the supports hold the upper frame and maintain the upper and lower frames substantially flat and substantially parallel to each other. Accordingly, the foldable frame is stable and comfortable to use. In addition, when folded, the folding mechanisms and supports allow the bent bars to move toward each other and fold onto each other tightly. As a result, the folded supporting frame is more compact and of a regular shape, making it easier to handle, package, store, and transport.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "left" or "right", "horizontal" or "vertical", "lateral" or "longitudinal" and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first link could be termed a second link, and, similarly, a second link could be termed a first link, without changing the meaning of the description, so long as all occurrences of the "first link" are renamed consistently and all occurrences of the "second link" are renamed consistently.

What is claimed is:

1. A foldable supporting frame, comprising:

a plurality of bent bars comprising first and second bent bars to form an upper frame, and third and fourth bent bars to form a lower frame, wherein each of the first, second, third and fourth bent bars comprises first and second free ends;

a plurality of supports, each comprising a supporting piece, wherein the supporting piece has an upper part pivotally connected to the upper frame and a lower part pivotally connected to the lower frame; and a plurality of folding mechanisms comprising first and second folding mechanisms, wherein each of the first and second folding mechanisms comprises:

a first link having a left upper part pivotally connected to the first or second free end of the first bent bar at a first pivot point, and having a right upper part pivotally connected to the first or second free end of the second bent bar at a second pivot point;

a second link having a lower part coupled to the first or second free end of the third bent bar; and a third link having a lower part coupled to the first or second free end of the fourth bent bar, wherein a lower part of the first link and upper parts of the second and third links are pivotally connected to each other at a third pivot point, and wherein the first, second and third pivot points are positioned triangularly.

2. The foldable supporting frame of claim 1, wherein for each of the first and second mechanisms, the second link is bent between the upper part and the lower part thereof, such that the upper part forms a recessed step with respect to the lower part thereof;

the third link is bent between the upper part and the lower part thereof, such that the upper part forms a recessed step with respect to the lower part thereof; and the first link, the second link and the third link are pivotally connected to each other within the recessed steps of the second and third links.

3. The foldable supporting frame of claim 2, wherein for each of the first and second mechanisms, bending edges of the second and third links are slanted with respect to a horizontal line when the foldable supporting frame is unfolded.

4. The foldable supporting frame of claim 1, wherein for each of the first and second mechanisms, the second link and the third link are positioned symmetrically with respect to each other.

5. The foldable supporting frame of claim 1, further comprising:

a plurality of crossbars, each crossbar having two ends connected to longitudinal parts of one of the first, second, third and fourth bent bars.

6. The foldable supporting frame of claim 1, wherein the free ends of the third bent bar are pivotally connected to the lower parts of the second links of the first and second mechanisms, and the free ends of the fourth bent bar are pivotally connected to the lower parts of the third links of the first and second mechanisms.

7. The foldable supporting frame of claim 1, wherein the free ends of the third bent bar are fixedly connected to the lower parts of the second links of the first and second mechanisms, and the free ends of the fourth bent bar are fixedly connected to the lower parts of the third links of the first and second mechanisms.

8. The foldable supporting frame of claim 1, wherein for each of the first and second folding mechanisms, the first pivot point at which the first link connects with the first bent bar and the second pivot point at which the first link connects with the second bent bar are positioned symmetrically with respect to the third pivot point at which the first link connects with the second and third links.

9. A foldable supporting frame, comprising:

a plurality of bent bars comprising first, second, third and fourth bent bars, wherein each of the first, second, third and fourth bent bars comprises first and second free ends;

a plurality of folding mechanisms comprising first and second folding mechanisms, wherein:

the first folding mechanism pivotally connects the first free end of the first bent bar with the first free end of the second bent bar, and the second mechanism pivotally connects the second free end of the first bent bar with the second free end of the second bent bar, thereby forming an upper frame of the foldable supporting frame; and the first folding mechanism pivotally connects the first free end of the third bent bar with the first free end of the fourth bent bar, and the second mechanism pivotally connects the second free end of the third bent bar with the second free end of the fourth bent bar, thereby forming a lower frame of the foldable supporting frame; and a plurality of supports, each comprising:

a supporting piece having an upper part pivotally connected to the upper frame of the foldable supporting frame and a lower part pivotally connected to the lower frame of the foldable supporting frame; and a restraining piece extended along a longitudinal edge of the supporting piece and bent at a predetermined angle with respect to the supporting piece, the restraining piece having an upper surface and a lower surface, wherein when the foldable supporting frame is unfolded, the upper surface of the restraining piece is below the upper frame of the foldable supporting frame and in direct contact with a lower surface of the upper frame, thereby preventing further unfolding of the foldable supporting frame.

10. The foldable supporting frame of claim 9, wherein the supporting piece and the restraining piece are perpendicular to each other.

11. The foldable supporting frame of claim 9, wherein each of the first, second, third and fourth bent bars comprises a lateral part and two longitudinal parts each extended longitudinally from one end of the lateral part, wherein the plurality of supports are disposed between a longitudinal part of the first bent bar and a corresponding longitudinal part of the third bent bar, and between a longitudinal part of the second bent bar and a corresponding longitudinal part of the fourth bent bar.

12. The foldable supporting frame of claim 9, wherein for at least one support, one of the upper and lower parts of the supporting piece comprises a horizontally extended first pivotal portion, wherein the first pivotal portion matches with a side surface of one of the upper and lower frames of the foldable supporting frame and is pivotally connected to the one of the upper and lower frames of the foldable supporting frame.

13. The foldable supporting frame of claim 12, wherein for the at least one support, the other of the upper and lower parts of the supporting piece comprises a vertically extended second pivotal portion, wherein the second pivotal portion matches with a side surface of the other of the upper and lower frames of the foldable supporting frame and is pivotally connected to the other of the upper and lower frames of the foldable supporting frame.

14. The foldable supporting frame of claim 13, wherein for the at least one support, the restraining piece, the first pivotal portion and the second pivotal portion are perpendicular to each other.

15. The foldable supporting frame of claim 9, wherein each support further comprises:

a connecting piece having an upper part pivotally coupled to the lower part of the supporting piece and a lower part fixedly coupled to the lower frame of the foldable supporting frame.

16. The foldable supporting frame of claim 15, wherein the connecting piece is perpendicular to the lower frame of the foldable supporting frame.

17. The foldable supporting frame of claim 15, wherein the connecting piece is bent in between the upper part and the lower part of the connecting piece.

18. The foldable supporting frame of claim 15, wherein the lower part of the supporting piece comprises a vertically extended second pivotal portion, wherein the second pivotal portion matches with a side surface of the connecting piece and is pivotally connected to the connecting piece.

19. The foldable supporting frame of claim 9, wherein each of the first and second folding mechanisms comprises:

a first link having a left upper part pivotally connected to the first or second free end of the first bent bar at a first pivot point, and having a right upper part pivotally connected to the first or second free end of the second bent bar at a second pivot point;

a second link having a lower part coupled to the first or second free end of the third bent bar; and a third link having a lower part coupled to the first or second free end of the fourth bent bar, wherein a lower part of the first link and upper parts of the second and third links are pivotally connected to each other at a third pivot point, and wherein the first, second and third pivot points are positioned triangularly.

* * * * *